US009573375B2

(12) United States Patent
Murayama

(10) Patent No.: US 9,573,375 B2
(45) Date of Patent: Feb. 21, 2017

(54) LIQUID EJECTING APPARATUS AND MAINTENANCE METHOD

(71) Applicant: SEIKO EPSON CORPORATION, Tokyo (JP)

(72) Inventor: Masato Murayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/814,240

(22) Filed: Jul. 30, 2015

(65) Prior Publication Data

US 2016/0031220 A1 Feb. 4, 2016

(30) Foreign Application Priority Data

Jul. 31, 2014 (JP) ..... 2014-155931

(51) Int. Cl.
*B41J 2/165* (2006.01)

(52) U.S. Cl.
CPC ..... *B41J 2/16535* (2013.01); *B41J 2/16544* (2013.01); *B41J 2002/1655* (2013.01)

(58) Field of Classification Search
CPC . B41J 2/16585; B41J 2/16535; B41J 2/16541; B41J 2/16538; B41J 2/16544; B41J 2/16547; B41J 2/16505; B41J 2/16523; B41J 2002/1655; B41J 2/16588
USPC ..... 347/22, 23, 29, 33
See application file for complete search history.

(56) References Cited

U.S. PATENT DOCUMENTS 6,631,975 B2 * 10/2003 Fukasawa ..... B41J 2/16547 347/33
2012/0026244 A1 2/2012 Inoue
2013/0120496 A1 * 5/2013 Nakamura ..... B41J 2/16535 347/33

FOREIGN PATENT DOCUMENTS

| | | | |
|---|---|---|---|
| JP | 03-281254 | A | 12/1991 |
| JP | 11-138857 | | 5/1999 |
| JP | 2007-130807 | A | 5/2007 |
| JP | 2009-226717 | A | 10/2009 |
| JP | 2012-030391 | A | 2/2012 |
| JP | 2012-232424 | A | 11/2012 |
| WO | WO2011099230 | | 8/2011 |

* cited by examiner

*Primary Examiner* — Jannelle M Lebron
(74) *Attorney, Agent, or Firm* — Workman Nydegger

(57) ABSTRACT

A liquid ejecting apparatus includes a liquid ejecting unit which has an opening face to which nozzles are open; a wiping member which can wipe off the opening face; and a movement mechanism which relatively moves the liquid ejecting unit and the wiping member in a wiping direction, in which as a wiping operation in which wiping of the opening face is performed by relatively moving the liquid ejecting unit and the wiping member at a speed, and it is possible to execute a movement operation in which the liquid ejecting unit and the wiping member are caused to relatively move in a state in which the liquid ejecting unit and the wiping member do not come into contact with each other at a speed higher than the speed.

9 Claims, 11 Drawing Sheets

LIQUID EJECTING APPARATUS AND MAINTENANCE METHOD

BACKGROUND

1. Technical Field

The present invention relates to a liquid ejecting apparatus such as an ink jet printer, and a maintenance method of the liquid ejecting apparatus.

2. Related Art

In the related art, as a type of a liquid ejecting apparatus, an ink jet printer which prints an image, or the like, by ejecting liquid onto a medium such as a sheet from nozzles of a liquid ejecting unit has been known. As a kind of such a printer, there is a printer which includes a wiper unit (wiping portion) for removing ink mist which is attached to an opening face of a liquid ejecting unit to which a nozzle is open in order to maintain liquid ejecting properties of the liquid ejecting unit (for example, International Publication No. WO 2011/99230).

With the wiper unit, an operation of wiping off ink mist which is attached to an opening face using an ink absorbing member is performed by moving a liquid ejecting unit in a state in which the ink absorbing member which is formed of cloth is pressed against the opening face of the liquid ejecting unit. In addition, a moving speed of the liquid ejecting unit is set low when it is assumed that an amount of ink deposit is large, since a wiping performance is improved when a wiping speed of ink is slow.

Meanwhile, when setting a relative moving speed between the liquid ejecting unit and the ink absorbing member at a time of wiping to a low level, there is a problem in that a time necessary for wiping becomes long. For this reason, it is necessary to efficiently perform wiping so that the time necessary for wiping does not become excessively long, while improving a wiping performance.

In addition, such a problem is not limited to wiping in which a liquid ejecting unit of a printer which performs printing by ejecting ink is wiped off using cloth, and is a common problem when wiping of a liquid ejecting unit is performed in a liquid ejecting apparatus.

SUMMARY

An advantage of some aspects of the invention is to provide a liquid ejecting apparatus in which wiping can be efficiently performed.

Hereinafter, means of the invention, and operation effects thereof will be described.

According to an aspect of the invention, there is provided a liquid ejecting apparatus which includes a liquid ejecting unit which has an opening face to which a plurality of nozzles which eject liquid onto a medium are open; a holding unit which holds a wiping member which can wipe off the opening face; a movement mechanism which relatively moves the liquid ejecting unit and the wiping member in a wiping direction within a movement region which includes a contact region in which the liquid ejecting unit and the wiping member come into contact with each other, and a non-contact region in which the liquid ejecting unit and the wiping member do not come into contact with each other; and a control unit which performs wiping by successively executing an wiping operation in which the opening face is wiped off by causing the liquid ejecting unit and the wiping member to relatively move in the contact region, and a movement operation in which the liquid ejecting unit and the wiping member are caused to relatively move in the non-contact region while controlling the movement mechanism, in which the control unit can select, as the wiping operation, a first wiping operation in which the relative movement is executed at a first speed, or a second wiping operation in which the relative movement is executed at a second speed which is lower than the first speed and can execute the movement operation at a speed which is higher than the second speed.

According to the configuration, when the second wiping operation is selected, it is possible to improve a wiping performance compared to a case in which the first wiping operation is selected since the wiping member and the liquid ejecting unit relatively move at the second speed which is lower than the first speed. Meanwhile, it is possible to reduce the time which is necessary for wiping compared to a case in which a movement operation is performed at the second speed, by performing the movement operation which is not accompanied by wiping of the liquid ejecting unit at a speed which is higher than the second speed. Accordingly, it is possible to efficiently perform wiping so that the time necessary for wiping does not become excessively long while improving the wiping performance.

In the liquid ejecting apparatus, the control unit may perform first wiping by successively executing the first wiping operation in which the relative movement is executed at the first speed, and the movement operation in which the relative movement is executed at the first speed, and may perform second wiping by successively executing the second wiping operation in which the relative movement is executed at the second speed, and the movement operation in which the relative movement is executed at the first speed.

According to the configuration, since the wiping member and the liquid ejecting unit relatively move at the second speed which is lower than the first speed in the wiping operation, when the second wiping is selected, it is possible to improve a wiping performance compared to a case in which the first wiping is selected. In addition, since the liquid ejecting unit and the wiping member relatively move at the first speed in the movement operation of the second wiping, it is possible to simplify control of the movement mechanism.

In the liquid ejecting apparatus, the control unit the control unit may perform first wiping by successively executing the first wiping operation in which the relative movement is executed at the first speed, and the movement operation in which the relative movement is executed at a moving speed which is higher than the first speed, and may perform second wiping by successively executing the second wiping operation in which the relative movement is executed at the second speed, and the movement operation in which the relative movement is executed at a moving speed which is higher than the first speed.

According to the configuration, since the wiping member and the liquid ejecting unit relatively move at the second speed which is lower than the first speed in the wiping operation, when the second wiping is selected, it is possible to improve a wiping performance compared to a case in which the first wiping is selected. In addition, since the liquid ejecting unit and the wiping member relatively move at a moving speed which is higher than the first speed in the movement operation of the first wiping and the second wiping, it is possible to reduce the time necessary for wiping compared to a case in which the movement operation is performed at the first speed or the second speed.

In the liquid ejecting apparatus, the wiping member may absorb liquid, and the control unit may increase the speed of the relative movement after contact between the wiping member and the nozzle ends in the wiping operation.

According to the configuration, since a relative movement speed when the wiping member and the nozzle come into contact with each other in the wiping operation is slower than a relative movement speed after a contact between the wiping member and the nozzle ends, it is possible to reliably absorb liquid in the vicinity of a nozzle opening using the wiping member. In addition, it is possible to reduce the time necessary for wiping by increasing a speed of the relative movement after contact between the wiping member and the nozzle ends.

The liquid ejecting apparatus may further include a support member which can support the medium; and an adjusting mechanism which can adjust a flight distance of liquid which is ejected onto the medium from the nozzle, by changing a distance between the liquid ejecting unit and the support member, in which, when the flight distance is a first distance, the first wiping operation may be selected, and when the flight distance is a second distance which is longer than the first distance, the second wiping operation may be selected.

When a flight distance of liquid is the second distance which is longer than the first distance, there is a high possibility that a larger amount of mist, which is generated accompanying the ejecting of ink, is generated, and the amount of liquid which is attached to the opening face increases compared to a case in which a flight distance of liquid is the first distance. In that point, according to the configuration, it is possible to more reliably wipe off liquid, even when a large amount of liquid is attached to the opening face, since the second wiping operation of which a relative movement speed is slower than that of the first wiping operation is performed when the flight distance is the second distance.

In the liquid ejecting apparatus, the wiping member may be formed of a long liquid absorbing member, the holding unit may rotatably hold a feeding roller, a press roller, and a winding roller, in the wiping operation, a wiping portion of the wiping member which is set between the feeding roller and the winding roller may be urged in a direction of facing the opening face by the press roller in a state in which a starting end of the wiping member in a longitudinal direction is wound around the winding roller, and a terminal end of the wiping member in the longitudinal direction is wound around the feeding roller, and the control unit may perform a winding operation which winds the wiping portion around the winding roller by rotating the winding roller in a winding direction while executing the wiping operation.

According to the configuration, since a position of the wiping portion which is in contact with the opening face is changed when the winding roller is rotated in the winding direction in the wiping operation, it is possible to suppress deterioration in liquid absorbing performance using the wiping member which is formed of a liquid absorbing member.

The liquid ejecting apparatus may further include a support member which can support the medium; and an adjusting mechanism which can adjust a flight distance of liquid which is ejected onto the medium from the liquid ejecting unit, by changing a distance between the liquid ejecting unit and the support member, in which the control unit may increase a rotation amount of the winding roller in the wiping operation, as the flight distance becomes longer.

When a flight distance of liquid which is ejected from the liquid ejecting unit is long, there is a possibility that mist which accompanies the ejecting of liquid may increase, and the amount of liquid which is attached to the opening face may increase. In that point, according to the configuration, it is possible to suppress deterioration in liquid absorbing performance using the wiping member which is formed of the liquid absorbing member, since the longer the flight distance of liquid, the larger the rotation amount of the winding roller in the wiping operation.

In the liquid ejecting apparatus, the wiping portion may move in the wiping direction in the wiping operation.

According to the configuration, since the wiping portion moves in the wiping direction in the winding operation, it is possible to reduce a friction force which is generated when the wiping member wipes off the opening face compared to a case in which the direction in which the wiping portion moves in the winding operation intersects the wiping direction, or a case in which the direction in which the wiping portion moves in the winding operation is a direction opposite to the wiping direction.

According to another aspect of the invention, there is provided a maintenance method which includes wiping off an opening face of a liquid ejecting unit to which a plurality of nozzles which eject liquid are open, by relatively moving a wiping member which can wipe off the opening face and the liquid ejecting unit at a first speed in a state in which the opening face, and the wiping member are caused to come into contact with each other; wiping off the opening face by relatively moving the wiping member and the liquid ejecting unit at a second speed which is lower than the first speed in a state in which the opening face and the wiping member are caused to come into contact with each other; and relatively moving the wiping member and the liquid ejecting unit at a speed which is higher than the second speed in a state in which the opening face and the wiping member are separated from each other.

According to the method, it is possible to obtain the same operation effect as that of the above described liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to drawings. The liquid ejecting apparatus is, for example, is an ink jet printer which performs recording (printing) by ejecting ink which is an example of liquid onto a medium such as a sheet.

First Embodiment

Figure 1:
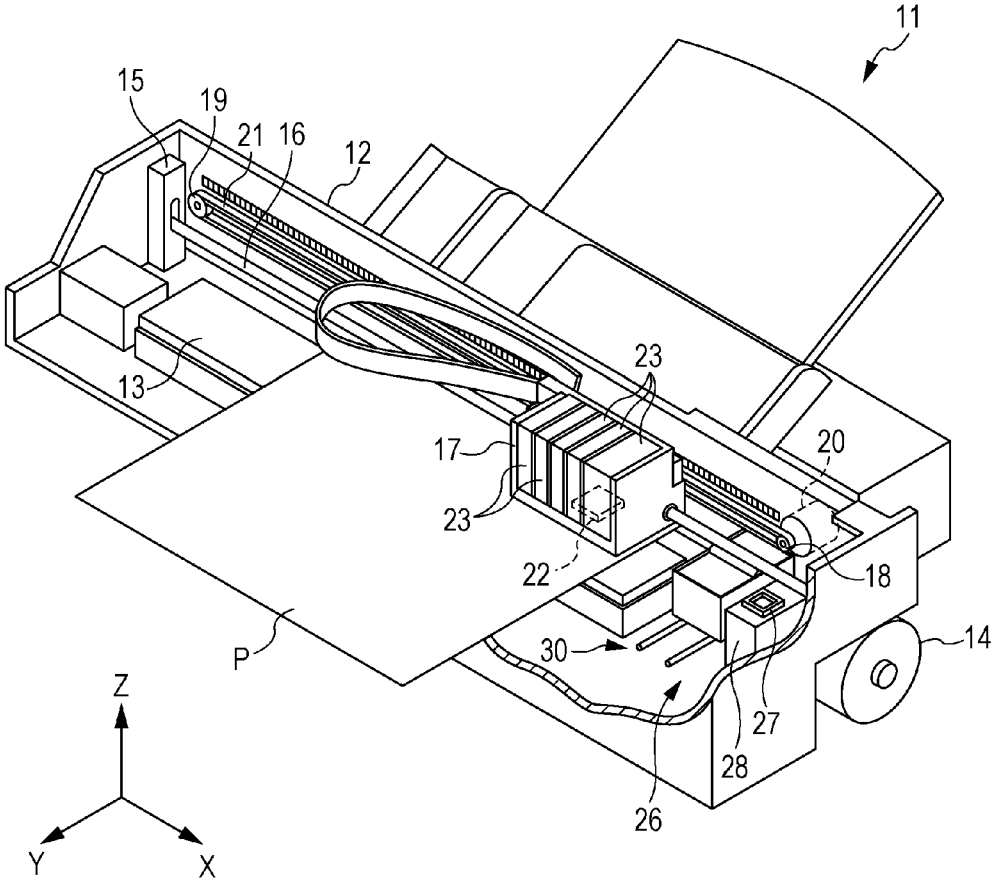
FIG. 1 is a perspective view which illustrates a first embodiment of a liquid ejecting apparatus.

As illustrated in FIG. 1, a liquid ejecting apparatus 11 includes a frame 12 which is in a substantially rectangular box shape, a support member 13 which can support a medium P in the frame 12, a guide shaft 16 which is installed along a longitudinal direction of the frame 12, and an adjusting mechanism 15 which can adjust a relative position of the guide shaft 16 with respect to the support member 13 by holding both ends of the guide shaft 16.

In addition, the liquid ejecting apparatus 11 includes a carriage 17 which is supported by the guide shaft 16 in a state in which the carriage can reciprocate along a scanning direction X which is a axial direction of the guide shaft 16, and a liquid ejecting unit 22 which is held by the carriage 17. A plurality of (five in the embodiment) liquid containers 23 in which liquid (for example, ink) to be supplied to the liquid ejecting unit 22 is accommodated is detachably mounted on the carriage 17.

For example, inks of cyan, magenta, yellow, black, and white are respectively accommodated in the five liquid containers 23. It is possible to perform color printing, or the like, by ejecting liquid which is supplied from each of the liquid containers 23 from the liquid ejecting unit 22.

A driving pulley 18 and a driven pulley 19 are rotatably supported on a wall portion which extends in the longitudinal direction of the frame 12. An output shaft of a carriage motor 20 which is a power source when causing the carriage 17 to reciprocate is connected to the driving pulley 18. In addition, an endless timing belt 21 of which a part is connected to the carriage 17 is hung between the pair of pulleys 18 and 19. In addition, the carriage 17 reciprocates along the scanning direction X while being guided by the guide shaft 16 when the timing belt 21 alternately moves around in one direction and an opposite direction thereof using the driving force of the carriage motor 20.

The medium P is transported in a transport direction Y which intersects (orthogonal, preferably) the scanning direction X on the support member 13 using the rotation force of a transport roller (not illustrated) which is driven by power of a transport motor 14 which is held in the frame 12.

In addition, the liquid ejecting apparatus 11 performs printing with respect to the entire medium P by alternately performing a transport process in which the medium P is transported by driving the transport motor 14 for a predetermined amount of time, and a printing process in which liquid droplets are ejected to the medium P which is supported by the support member 13 while causing the liquid ejecting unit 22 to reciprocate in a movement region by driving the carriage motor 20. According to the embodiment, an ejecting direction Z in which the liquid ejecting unit 22 ejects liquid is a direction which intersects (orthogonal, preferably) both the scanning direction X and the transport direction Y.

In a movement region which extends along the scanning direction X of the carriage 17, a region in which the support member 13 is arranged is referred to as a printing region, and a region which is the outside of the printing region is referred to as a non-printing region. In addition, when executing a printing process, the carriage 17 performs deceleration, a change of direction, and acceleration in the non-printing region after performing moving at an equal speed in the printing region. That is, the non-printing region is also a region in which the carriage 17 which is reciprocating changes direction.

The adjusting mechanism 15 changes a distance between the liquid ejecting unit 22 and the support member 13 by adjusting a relative position of the guide shaft 16 with respect to the support member 13 according to a thickness or a type of the medium P. When the distance from the liquid ejecting unit 22 to the surface of the medium P which is supported by the support member 13 is set to an interval PG, the adjusting mechanism 15 adjusts the interval PG by changing the distance between the liquid ejecting unit 22 and the support member 13 according to a thickness or a type of the medium P.

In addition, when the adjusting mechanism 15 adjusts the interval PG, a flight distance of liquid which is ejected onto the medium P from the liquid ejecting unit 22 is adjusted. For this reason, in the liquid ejecting apparatus 11 according to the embodiment, it is possible to maintain an appropriate printing quality even in a case in which a medium P with a different thickness, for example, a medium P of a different type such as paper, cloth, or a film is set to a printing target.

In the inside of the frame 12, a maintenance unit 26 for performing maintenance of the liquid ejecting unit 22 is provided in a non-printing region which is one end portion in the movement region of the carriage 17. The maintenance unit 26 includes a cap 27 for performing capping, a suctioning mechanism 28 which can perform suctioning in the inside the cap 27, and a wiper unit 30 for wiping off liquid, dirt, or the like, which is attached to the liquid ejecting unit 22.

According to the embodiment, in a movement region of the liquid ejecting unit 22 which extends in the scanning direction X, a position in which the cap unit is arranged is referred to as a home position. In addition, according to the embodiment, a direction from the home position to a printing region is set to the scanning direction X.

Figure 2:
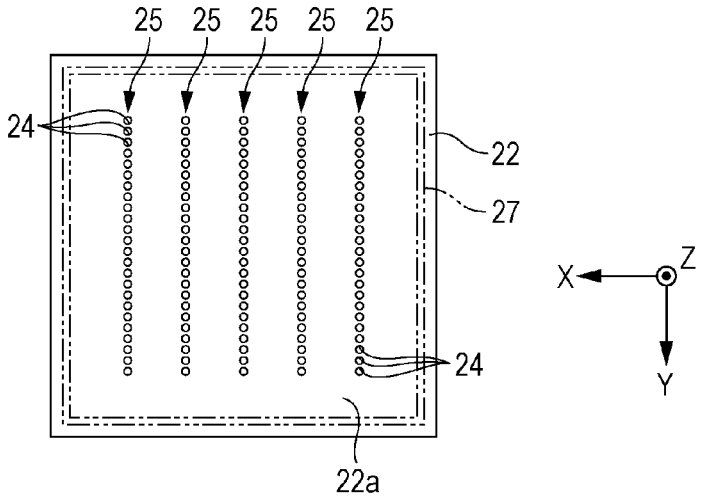
FIG. 2 is a bottom view which illustrates a configuration of a liquid ejecting unit which is included in the liquid ejecting apparatus in FIG. 1.

As illustrated in FIG. 2, the liquid ejecting unit 22 includes an opening face 22*a* to which a plurality of nozzles 24 which eject liquid are open. The plurality of nozzles 24 form a nozzle column 25 by being aligned along the transport direction Y. In addition, according to the embodiment, a plurality of the nozzle columns 25 (five) which are provided corresponding to a type of liquid are arranged at regular intervals in the scanning direction X.

The cap 27 performs capping in which a closed space to which the nozzle 24 is open is formed by coming into contact with the opening face 22*a* by performing a relatively movement in a direction to the liquid ejecting unit 22, when the liquid ejecting unit 22 is arranged at the home position. In addition, it is possible to suppress clogging due to drying of the nozzle 24 by performing capping with respect to the liquid ejecting unit 22, by arranging the liquid ejecting unit at the home position at a time of powering off, or the like.

In addition, as a maintenance operation of the liquid ejecting unit 22, it is also possible to perform flushing in which liquid is ejected (thrown away) toward the cap 27 from the liquid ejecting unit 22 when the cap 27 is located at a position that is separated from the liquid ejecting unit 22.

In addition, suction cleaning in which foreign substances such as bubbles in the liquid ejecting unit 22 are discharged along with liquid through the nozzle 24 is performed by driving the suctioning mechanism 28 in a state in which capping is performed. In addition, it is preferable to wipe off the opening face 22*a* using wiping, since there is a case in which liquid droplets which are discharged from the nozzle 24 are attached to the opening face 22*a* after executing the suction cleaning.

In addition, when printing is performed by ejecting liquid toward the medium P from the liquid ejecting unit 22, there is a case in which part of the liquid which is ejected toward the medium P is atomized, and floats between the opening face 22*a* and the medium P as mist. There is a case in which such mist flows along with a current of air which is generated due to a reciprocating movement of the carriage 17, ejecting of liquid, or the like, and is attached to the opening face 22*a* of the liquid ejecting unit 22. In addition, the reason that part of ejected liquid is atomized, and floats as mist is that a reaction force such as air resistance works in a direction opposite to an ejecting direction with respect to liquid which is ejected toward the medium P.

In addition, when liquid is attached to the opening face 22*a*, and becomes liquid droplets in this manner, there is a concern that the liquid droplets may come into contact with liquid droplets which are ejected from the nozzle 24, a flight direction of the ejected liquid droplets may be changed, and a printing quality may deteriorate. For this reason, when liquid is attached to the opening face 22*a* due to a printing operation, suction cleaning, or the like, wiping using the wiper unit 30 is performed, and liquid which is attached to the opening face 22*a* is removed.

In addition, when wiping is performed, there is a case in which a meniscus which is formed in the nozzle 24 (liquid face which is curved in concave shape) is collapsed, it is preferable to re-shape the meniscus in the nozzle 24 by performing flushing after executing wiping.

Hereinafter, a configuration of the wiper unit 30 will be described in detail.

Figure 3:
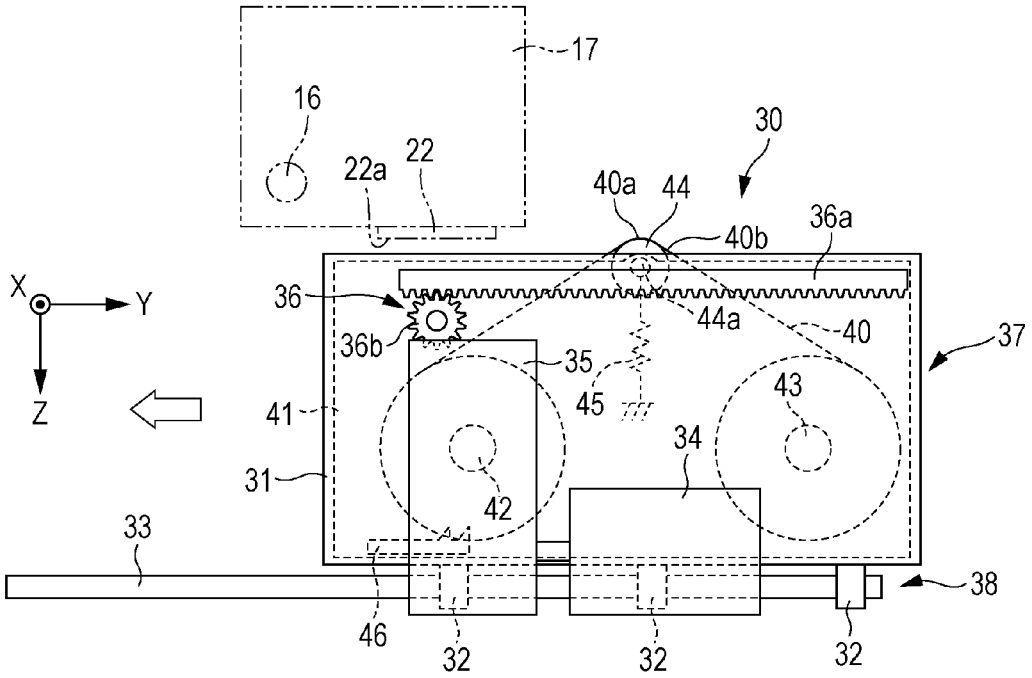
FIG. 3 is a side view which illustrates a schematic configuration of a wiper unit which is included in the liquid ejecting apparatus in FIG. 1.

As illustrated in FIG. 3, the wiper unit 30 includes a holding unit 37 which holds a wiping member 40 which is formed of a long liquid absorbing member which can wipe off the opening face 22*a*, and a movement mechanism 38 for moving the holding unit 37 along the transport direction Y.

The wiping member 40 is formed of non-woven fabric such as a synthetic resin, for example, and when the wiping member 40 comes into contact with the opening face 22*a* to which liquid is attached, liquid which is attached to the opening face 22*a* is absorbed in fibers which form the wiping member 40, and intervals (voids) between the fibers. In addition, the wiping member 40 may be woven fabric of synthetic fiber, woven fabric of natural fiber, or non-woven fabric as long as the wiping member can absorb liquid.

The movement mechanism 38 includes a rail unit 33 which extends in the transport direction Y, a driving motor 34, and a power transmission mechanism 35 which transmits power of the driving motor 34, and the holding unit 37 is moved along a wiping direction (direction denoted by outline arrow in FIG. 3) using the driving force of the driving motor 34 which is transmitted through the power transmission mechanism 35. According to the embodiment, the wiping direction is a movement direction of the holding unit 37, and is a direction opposite to the transport direction Y.

The transport direction Y is the longitudinal direction of the holding unit 37, and the holding unit includes a wiper holder 31, and a wiper cassette 41 which is detachably mounted on the wiper holder 31. The wiper holder 31 is engaged with the rail unit 33 through a guide unit 32 which is fixed to the lower part thereof.

A rack and pinion mechanism 36 is provided on a side wall of the wiper holder 31. The rack and pinion mechanism 36 includes a rack 36*a* which is fixed to a side face of the wiper holder 31, and extends in the wiping direction, and a pinion 36*b* which engages with the rack 36*a*, and rotates using power which is transmitted through the power transmission mechanism 35.

In addition, when the driving motor 34 is driven in the first direction, the holding unit 37 moves in the wiping direction along with the rack 36*a*, with the driving force of the driving motor 34 transmitted to the rack 36*a* through the power transmission mechanism 35 and the pinion 36*b*. In addition, when the driving motor 34 is driven in the second direction which is opposite to the first direction, the holding unit 37 moves in the transport direction Y along with the rack 36*a*, with the driving force of the driving motor 34 transmitted to the rack 36*a* through the power transmission mechanism 35 and the pinion 36*b*.

The wiper cassette 41 rotatably holds a winding roller 43, a press roller 44, and a feeding roller 42 which are aligned in order at a distance in the wiping direction, and holds an urging member 45 which urges a spindle 44*a* pivotally supporting the press roller 44. The urging member 45 can be configured of a coil spring or a flat spring which is a compression spring, an elastic body which can be elastically deformed, or the like, for example. In addition, when the press roller 44 includes a circumferential surface which can be elastically deformed, and if the spindle 44*a* can be urged using the press roller 44, the urging member 45 may not be included.

According to the embodiment, in a state in which the wiper cassette 41 is mounted on the wiper holder 31, an axial direction of the rollers 42, 43, and 44 which are pivotally supported by the wiper cassette 41 is set to the scanning direction X. In addition, a wiping direction which is the relative movement direction of the liquid ejecting unit 22 and the wiping member 40 when performing wiping is parallel to a direction in which each nozzle column 25 of the liquid ejecting unit 22 extends (nozzle column direction).

The wiping portion 40*a* of the wiping member 40 which is set between the feeding roller 42 and the winding roller 43 is urged toward the outside of the wiper cassette 41 by the press roller 44 in a state in which a starting end of the wiping member 40 in the longitudinal direction is wound around the winding roller 43, and a terminal end of the wiping member 40 in the longitudinal direction is wound around the feeding roller 42.

When the wiper cassette 41 is mounted on the wiper holder 31, the wiping portion 40*a* of the wiping member 40 protrudes from the holding unit 37 through an opening portion (not illustrated) which is provided in the wiper cassette 41 and the wiper holder 31 in a state of being urged toward the opening face 22*a*.

In addition, when the holding unit 37 moves in the wiping direction in a state in which the liquid ejecting unit 22 stops at a position corresponding to the wiper unit 30 in the scanning direction X, wiping is performed with the wiping portion 40*a* wiping off the opening face 22*a* while absorbing liquid which is attached to the opening face 22*a*. In this manner, a position at which the liquid ejecting unit 22 can come into contact with the wiping member 40 in a movement region of the liquid ejecting unit 22 which extends in the scanning direction X is referred to as a wiping position.

When the wiping portion 40*a* absorbs liquid, or the like, the wiping member 40 is wound around the winding roller 43 by performing a winding operation in which the winding roller 43 rotates in the winding direction (clockwise in FIG. 3). In this manner, the wiping member 40 is wound off of the feeding roller 42 by the same length as the wiping member 40 is wound at the same time as moving of the wiping portion 40*a* in the wiping direction, an used portion of the wiping member 40 which has absorbed liquid is wound around the winding roller 43, and a portion of the wiping member 40 which is not used becomes a new wiping portion 40*a*.

In addition, it is preferable to provide a ratchet 46 which allows the feeding roller 42 to rotate in a feeding direction (clockwise in FIG. 3) when the winding roller 43 winds up the wiping member 40, and regulates rotating of the feeding roller 42 in the feeding direction in other cases, in the wiper cassette 41. The reason for this is that it is possible to suppress slack of the wiping member 40 between the winding roller 43 and the feeding roller 42.

Figure 4A:
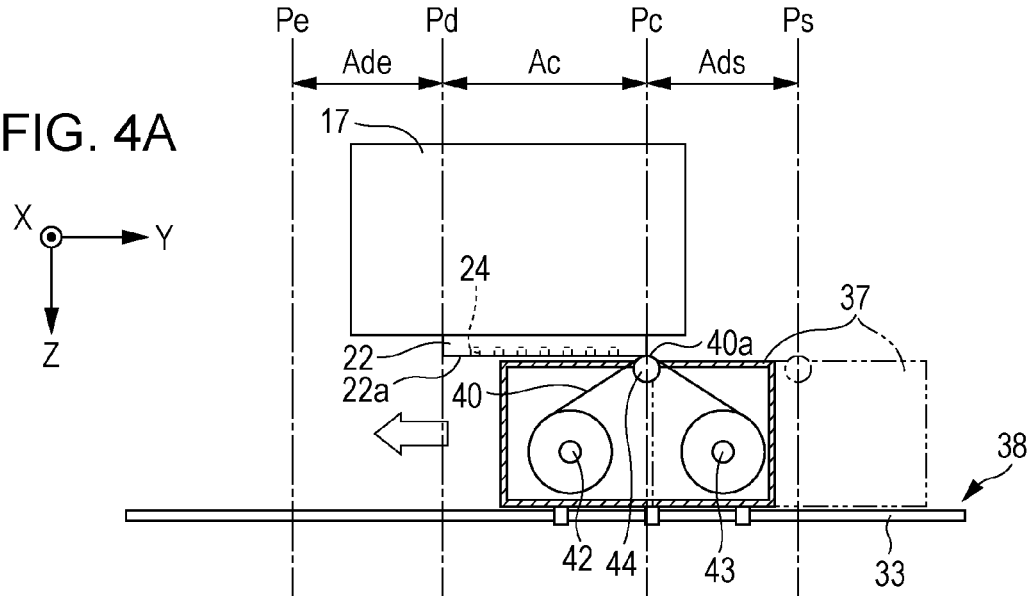
FIGS. 4A, 4B, and 4C are schematic diagrams which illustrate a state in which the wiper unit in FIG. 3 moves.
Figure 4B:
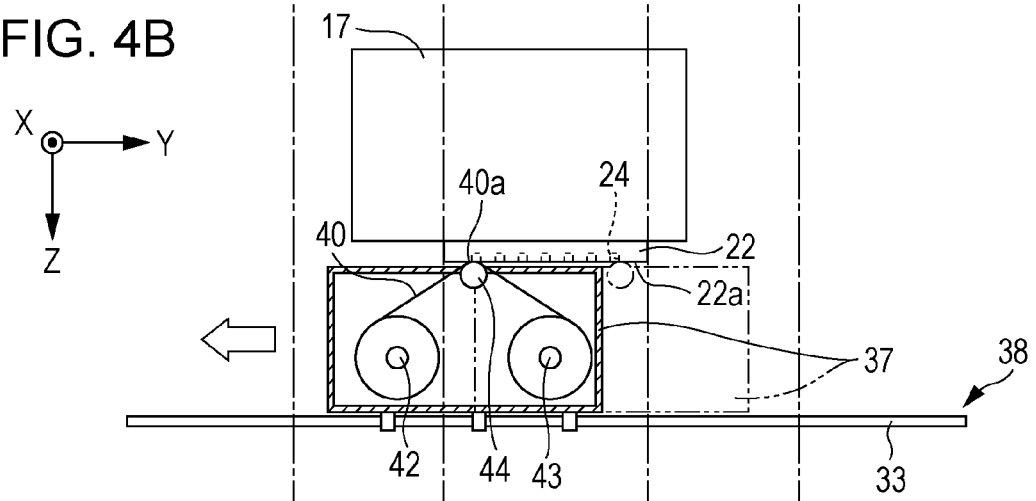
Figure 4C:
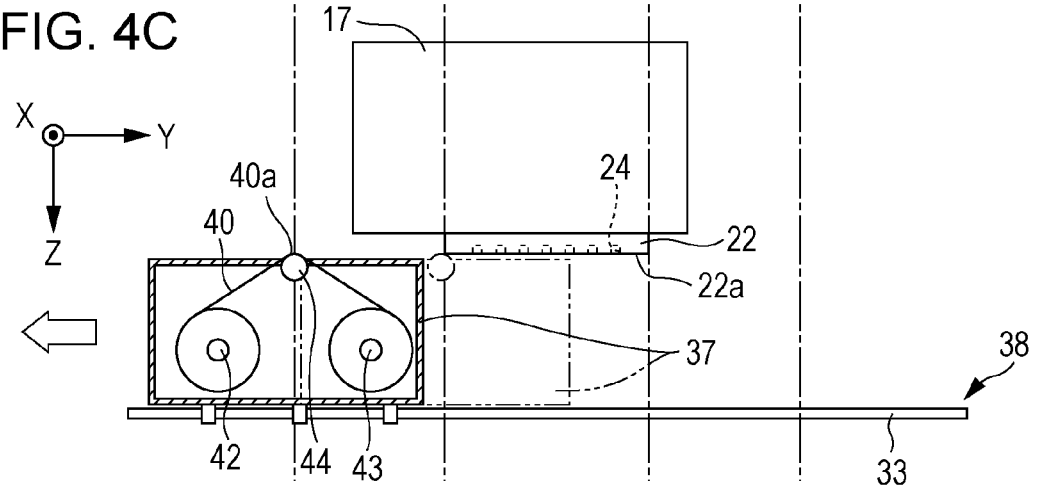

As illustrated in FIGS. 4A to 4C, the holding unit 37 performs wiping in a process of performing a outward movement from a movement start position Ps which is set at one end portion in a movement region which extends in the wiping direction (right end portion in FIG. 4A) to a movement end position Pe which is set at the other end portion in the movement region (left end portion in FIG. 4C). In addition, when the wiping ends, the holding unit is in standby until the subsequent wiping after performing a homeward movement toward the movement start position Ps from the movement end position Pe.

Here, it is preferable to prevent the liquid ejecting unit 22 and the wiping portion 40*a* from coming into contact with each other when the liquid ejecting unit 22 moves to the wiping position before wiping, or moves to another position from the wiping position after the wiping.

Therefore, the movement mechanism 38 causes the liquid ejecting unit 22 and the wiping member 40 to relatively move in the wiping direction in the movement region which includes a contact region Ac in which the liquid ejecting unit 22 and the wiping member 40 can come into contact each other, and non-contact regions Ads and Ade in which the liquid ejecting unit 22 and the wiping member 40 may not come into contact each other. In addition, when the liquid ejecting unit 22 moves with respect to the wiping position, the moving liquid ejecting unit 22 is prevented from coming contact with the wiping member 40 by arranging the wiping member 40 in the non-contact region Ads or Ade.

In the movement region of the wiping member 40 which extends in the wiping direction, a position at which the liquid ejecting unit 22 and the wiping member 40 which relatively move start to come into contact with each other is set to a contact start position Pc, and a position at which the liquid ejecting unit 22 and the wiping member 40 are separated from each other is set to a contact end position Pd. In this case, a region from the movement start position Ps to the start end position Pc in the wiping direction is set to the non-contact region Ads, and a region from the contact start position Pc to the contact end position Pd in the wiping direction is set to the contact region Ac, and a region from the contact end position Pd to the movement end position Pe in the wiping direction is set to the non-contact region Ade.

In addition, an operation in which the wiping portion 40*a* which moves from the movement start position Ps (position denoted by two-dot dash line in FIG. 4A) to the contact start position Pc (position denoted by solid line in FIG. 4A) is referred to as a former movement operation. In addition, an operation in which the wiping member 40 moves from the contact start position Pc to the contact end position Pd (position denoted by two-dot dash line in FIG. 4C) while being in contact with the opening face 22*a* is referred to as a wiping operation. In addition, an operation in which the wiping portion 40*a* moves from the contact end position Pd to the movement end position Pe (position denoted by solid line in FIG. 4C) is referred to as a latter movement operation.

In the embodiment, when the liquid ejecting unit 22 moves to a wiping position along the scanning direction X before wiping, or moves to another position from the wiping position after the wiping, the holding unit 37 is arranged at the movement start position Ps which is an end of the non-contact region Ads.

Subsequently, an electrical configuration of the liquid ejecting apparatus 11 which is related to a control of the wiper unit 30 will be described.

Figure 5:
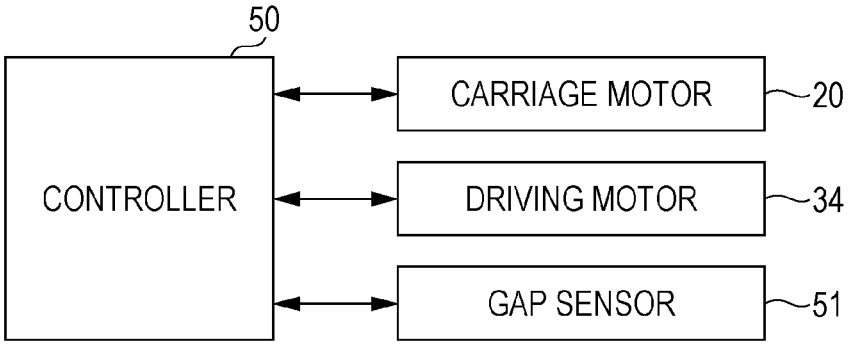
FIG. 5 is a block diagram which illustrates an electrical configuration of the liquid ejecting apparatus in FIG. 1.

As illustrated in FIG. 5, the liquid ejecting apparatus 11 includes a control unit 50 which is in charge of the maintenance control of the liquid ejecting unit 22, or the like. The carriage motor 20 and the driving motor 34 are electrically connected to an input-output interface of the control unit 50. In addition, an interval sensor 51 which detects the interval PG between the opening face 22*a*of the liquid ejecting unit 22 and the surface of the medium P which is supported by the support member 13 is electrically connected to the input-output interface of the control unit 50.

In addition, the control unit 50 controls driving of the carriage motor 20, the driving motor 34, and the like, according to a size of the interval PG which is detected using the interval sensor 51. For example, when the control unit 50 controls the movement mechanism 38 through the driving motor 34, wiping is performed by successively executing a wiping operation in which wiping-off of the opening face 22*a* is performed by causing the liquid ejecting unit 22 and the wiping member 40 to relatively move in the contact region Ac, and a movement operation in which the liquid ejecting unit 22 and the wiping member 40 are caused to relatively move in the non-contact regions Ads and Ade.

In addition, the control unit 50 can select a first wiping operation in which a relative movement between the liquid ejecting unit 22 and the wiping member 40 is executed at a first speed VW1, or a second wiping operation in which the relative movement is executed at a second speed VW2 which is lower than the first speed VW1 as a wiping operation in the contact region Ac. In addition, the control unit 50 can execute the movement operation in the non-contact regions Ads and Ade at a movement speed VW0 which is higher than the first speed VW1 and the second speed VW2 (VW0>VW1>VW2).

Subsequently, an absorbing state of ink using the wiping member 40 will be described.

Figure 6:
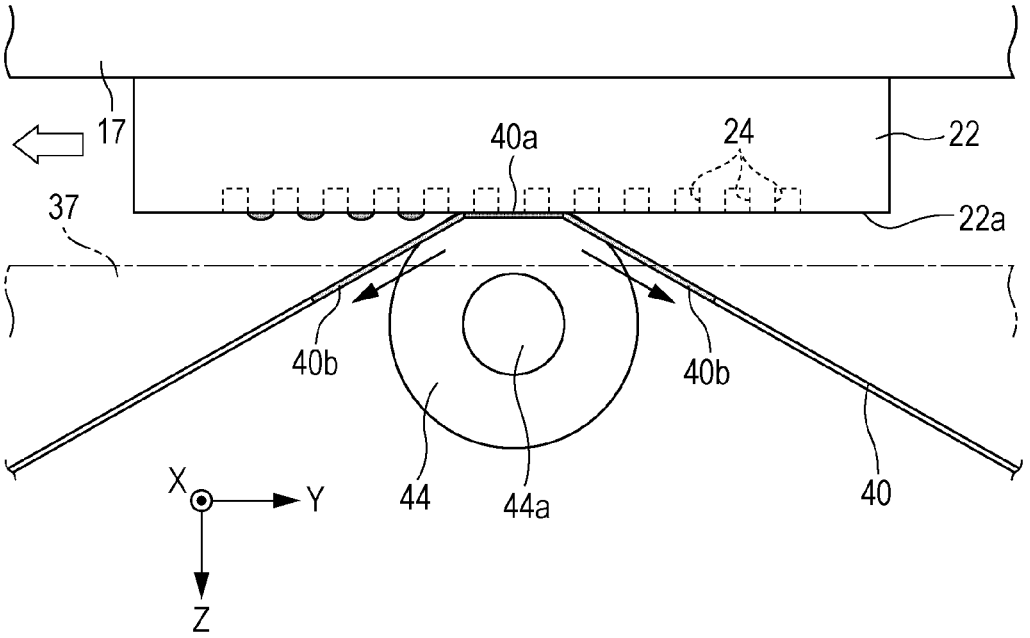
FIG. 6 is a side view which schematically illustrates a state in which liquid is absorbed into a wiping member.

As illustrated in FIG. 6, when the wiping member 40 comes into contact with the opening face 22*a* of the liquid ejecting unit 22 in the wiping operation, liquid which is attached to the opening face 22*a* is absorbed into the wiping portion 40*a* which is in contact with the opening face 22*a*.

That is, the wiping portion 40*a* absorbs liquid by coming into a direct contact with the opening face 22*a* at a time of a wiping operation.

Liquid which is absorbed into the wiping portion 40*a* permeates a portion which is located on the upstream side in the feeding direction (left side in FIG. 6), and a portion which is located on the downstream side in the winding direction (right side in FIG. 6). In this manner, a portion which is close to the wiping portion 40*a* in the longitudinal direction is not in direct contact with the opening face 22*a* at a time of the wiping operation; however, the portion is referred to as a permeation portion 40*b* since the absorbed liquid permeates the portion when the wiping portion 40*a* absorbs liquid.

That is, the wiping member 40 can absorb an amount of liquid which can be absorbed into the wiping portion 40*a* which comes into contact with the opening face 22*a*, that is, liquid of a volume or more corresponding to an opening of the wiping portion 40*a*, since liquid which is absorbed into the wiping portion 40*a* permeates the permeation portion 40*b* even when winding using the winding roller 43 is not performed.

For this reason, when an amount of liquid which is attached to the opening face 22*a* is less than an amount of liquid which can be absorbed into the wiping portion 40*a*, there is a high possibility that liquid which is attached to the opening face 22*a* can be completely removed by moving the wiping member 40 at a speed which is higher than a permeation speed of liquid from the wiping portion 40*a* to the permeation portion 40*b*.

On the other hand, when the amount of liquid which is attached to the opening face 22*a* is the amount of liquid which can be absorbed into the wiping portion 40*a* or more, there is a high possibility that liquid attached to the opening face 22*a* may not be completely removed when the wiping member 40 is moved at a speed of a permeation speed of liquid from the wiping portion 40*a* to the permeation portion 40*b* or more. In addition, in this case, there is a concern that liquid ejecting properties of the liquid ejecting unit 22 may deteriorate due to intruding of liquid which is attached to the opening face 22*a* or bubbles into the nozzle 24, when the wiping portion 40*a* which has absorbed liquid to the maximum limit comes into contact with the opening face 22*a*.

Accordingly, when there is a large amount of liquid which is attached to the opening face 22*a*, it is preferable to prompt permeation of liquid with respect to the permeation portion 40*b* by setting a movement speed VW of the wiping member 40 to be relatively slow. Alternatively, it is preferable to set a portion of the wiping member 40 which does not absorb liquid yet to a new wiping portion 40*a* by winding the wiping member 40 around the winding roller 43, in order to change a position of the wiping portion 40*a* which is in a state of absorbing liquid to the limit.

Subsequently, determining whether an amount of liquid which is attached to the opening face 22*a* of the liquid ejecting unit 22 is small or large will be described.

In the liquid ejecting apparatus 11 according to the embodiment, mediums P of different types, or mediums P with different thicknesses are set as printing targets. In addition, when the types or the thicknesses of mediums P are different from each other, printing which is appropriate to each medium P is performed by appropriately changing the distance between the opening face 22*a* and the surface of a medium P which is arranged on the support member 13 when liquid is ejected from the liquid ejecting unit 22, that is, the interval PG.

Figure 7A:
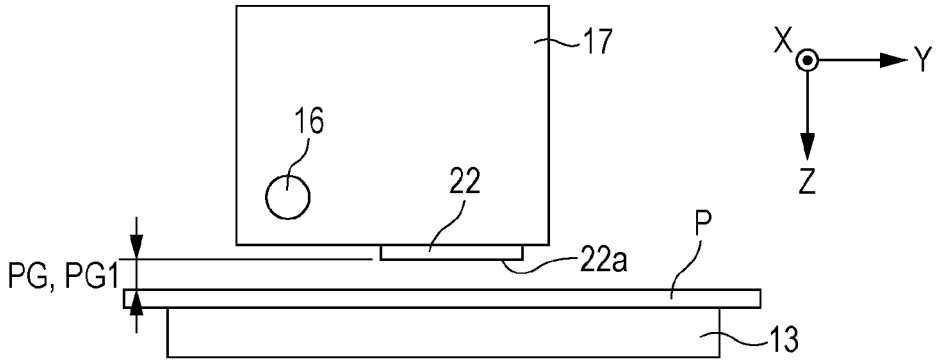
FIGS. 7A and 7B are schematic diagrams which describe two cases with different intervals.

In addition, as illustrated in FIG. 7A, when the interval PG when liquid is ejected onto a medium P which is supported by the support member 13 is relatively small (for example, a case of first distance PG1), liquid which is ejected from the liquid ejecting unit 22 is hardly influenced by air resistance, or the like, and there is a small amount of mist generated, since a flight distance of liquid becomes short.

Figure 7B:
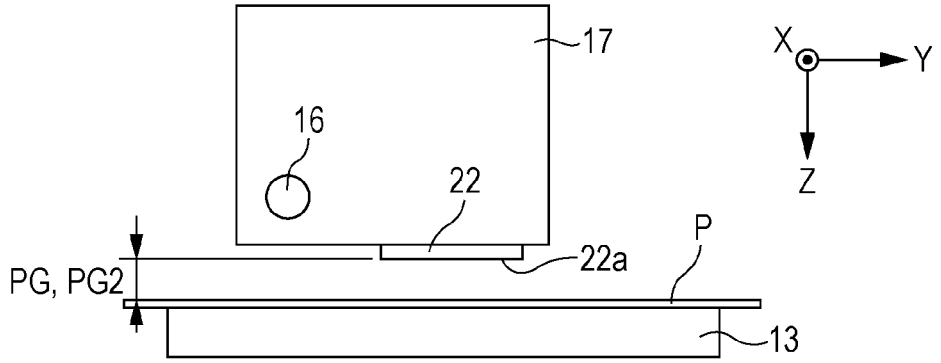

On the other hand, as illustrated in FIG. 7B, when the interval PG when ejecting liquid is relatively large (for example, a case of second distance PG2, PG2>PG1), liquid which is ejected from the liquid ejecting unit 22 is easily influenced by air resistance, or the like, and there is a large amount of mist generated, since a flight distance of liquid becomes long. In addition, in FIGS. 7A and 7B, there is a difference in size in the interval PG due to a difference in thickness of a medium P; however, when a distance between the opening face 22*a* and the support member 13 is changed, there is a case in which a difference in size of the interval PG occurs, similarly, even when the thickness of the medium P is the same.

In this manner, when the interval PG is large at a time of ejecting liquid, an amount of mist generated increases compared to a case in which the interval PG is small, and an amount of liquid which is attached to the opening face 22*a* increases. In addition, when the amount of liquid which is attached to the opening face 22*a* of the liquid ejecting unit 22 is large, it is preferable to set a movement speed of the wiping member 40 when performing a wiping operation slow, compared to a case in which the amount of liquid attached to the opening face 22*a* is small.

For this reason, according to the embodiment, when a flight distance of liquid is the first distance PG1, it is determined that the amount of liquid which is attached to the liquid ejecting unit 22 is relatively small, and the first wiping is performed in which a movement speed of the wiping member 40 in the contact region Ac is set to the first speed VW1. That is, as the wiping operation, the first wiping operation is selected. On the other hand, when a flight distance of liquid is the second distance PG2 which is longer than the first distance PG1, it is determined that the amount of liquid which is attached to the liquid ejecting unit 22 is relatively large, and the second wiping is performed in which a movement speed of the wiping member 40 in the contact region Ac is set to the second speed VW2 which is lower than the first speed VW1 (VW1>VW2). That is, as the wiping operation, the second wiping operation is selected.

In addition, the second wiping is executed when the amount of liquid which is attached to the liquid ejecting unit 22 is large. For this reason, it is also preferable to execute the second wiping when printing time is long, an ejecting amount of liquid per unit time is large, or the like, for example, in addition to the case in which a flight distance of liquid is long.

However, it is preferable that the time which is necessary for performing wiping is short. Therefore, according to the embodiment, when the wiping member 40 is moved in order to perform wiping, a movement speed of the wiping member 40 in the non-contact region Ads is set to a relative movement speed or more of the wiping member 40 in the contact region Ac. For example, in the first and second wiping, a movement speed of the wiping member 40 in the non-contact region Ads is set to the movement speed VW0 which is higher than the first speed VW1 and the second speed VW2 (VW0>VW1>VW2) which are movement speeds in the contact region Ac.

Subsequently, as a maintenance method of the liquid ejecting unit 22, wiping which is executed by the liquid ejecting apparatus 11 will be described.

When a printing process with respect to a medium P is completed, wiping in which the wiping member 40 wipes off the liquid ejecting unit 22 is performed in order to remove liquid which is attached to the opening face 22*a* due to the printing process.

When performing wiping, first, the carriage 17 is moved to a wiping position in a state in which the holding unit 37 is stopped at the movement start position Ps which is illustrated in FIG. 4A. Subsequently, the control unit 50 causes the driving motor 34 to be driven in the first direction in order to move the holding unit 37 in the wiping direction from the movement start position Ps.

Figure 8A:
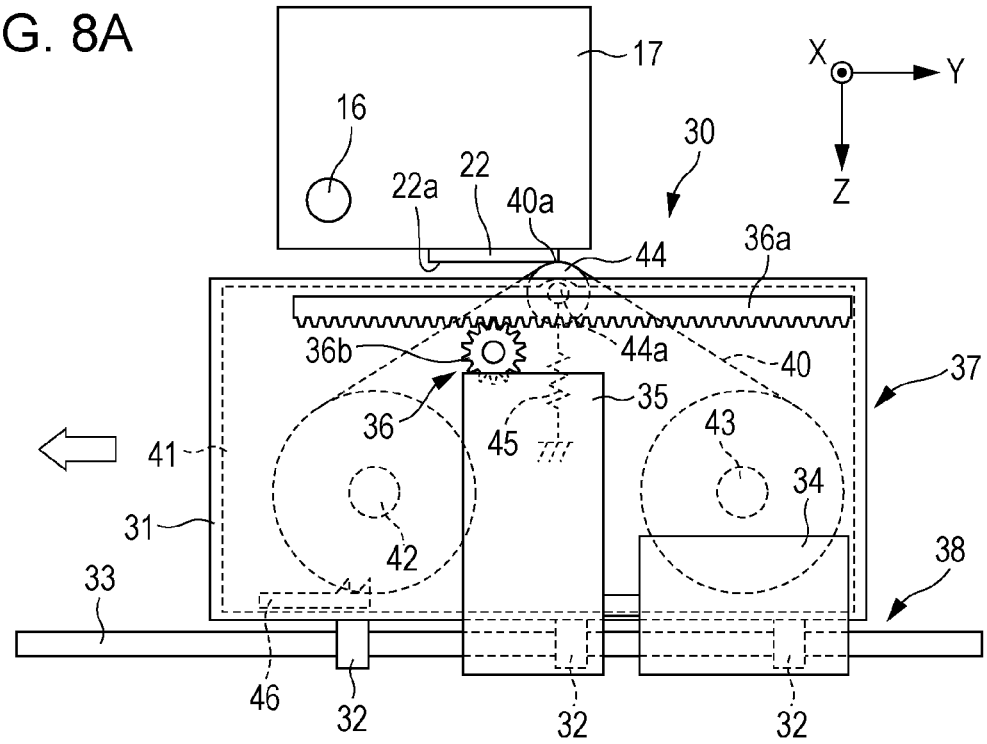
FIGS. 8A and 8B are schematic diagrams which describe wiping operations in the first embodiment.

Thereafter, as illustrated in FIG. 8A, the holding unit 37 moves in the wiping direction which is denoted by the outline arrow in the figure along with the rack 36*a* when the driving force of the driving motor 34 is transmitted to the rack 36*a* through the power transmission mechanism 35 and the pinion 36*b*. In addition, when the wiping portion 40*a* reaches the contact start position Pc which is illustrated in FIG. 8A, the wiping portion 40*a* comes into contact with an end portion of the opening face 22*a* of the liquid ejecting unit 22, and is pressed against the opening face 22*a* using the press roller 44 which is urged by the urging member 45. In addition, an operation from the start of a movement of the holding unit 37 in the wiping direction to contact of the wiping portion 40*a* with the opening face 22*a* is the former movement operation.

Figure 8B:
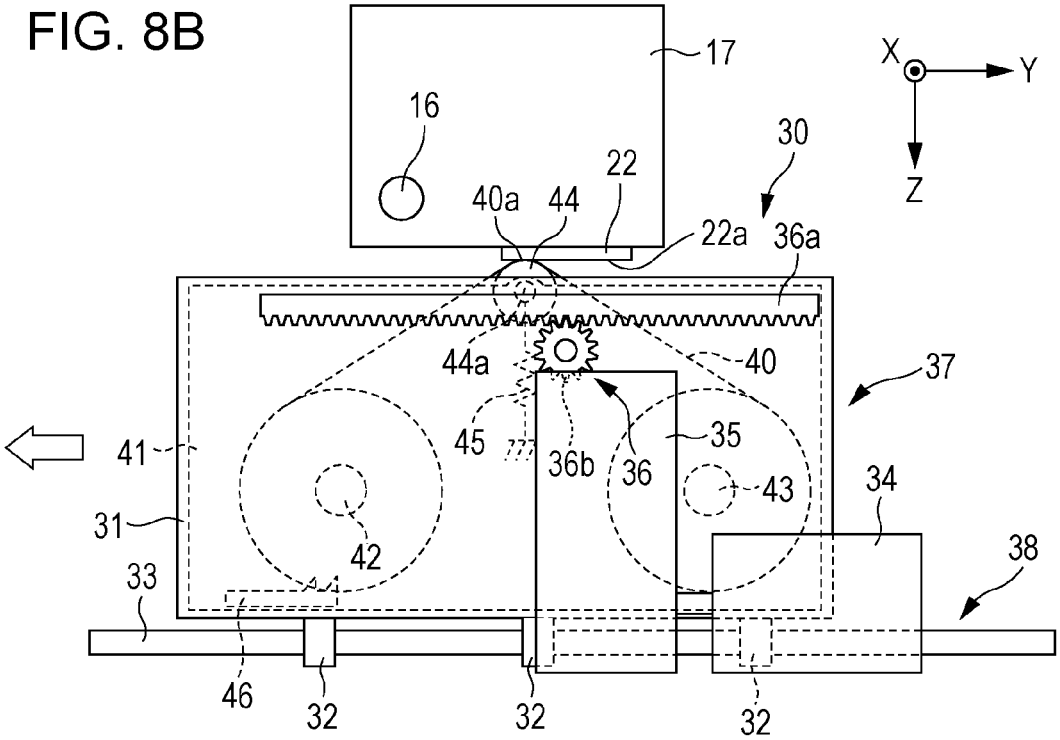

As illustrated in FIG. 8B, when the holding unit 37 moves in the wiping direction which is denoted by an outline arrow in the figure in a state in which the wiping member 40 is pressed against the opening face 22*a*, the wiping portion 40*a* wipes off the opening face 22*a*. In this manner, the wiping operation is performed when the holding unit 37 moves in the wiping direction in a state in which the wiping portion 40*a* comes into contact with the opening face 22*a*.

In the wiping operation, a friction force which is generated when the wiping portion comes into contact with the opening face 22*a* acts on the wiping portion 40*a* of the wiping member 40 in a direction opposite to the wiping direction. In addition, the friction force acts in a feeding direction of the wiping member 40 which is wound around the feeding roller 42; however, excessive feeding of the wiping member 40 is suppressed by regulating a rotation of the feeding roller 42 using the ratchet 46.

The wiping operation is completed when the wiping portion 40*a* is separated from the liquid ejecting unit 22 at the contact end position Pd which is denoted by the two-dotted dashed line in FIG. 4C, and thereafter, the latter movement operation is performed when the holding unit 37 continuously moves in the wiping direction. In addition, when the wiping portion 40*a* moves to a movement end position which is denoted by a solid line in FIG. 4C, the latter movement operation is completed.

In addition, when the wiping portion 40*a* moves to the movement end position Pe due to the latter movement operation, a regulation of rotation of the feeding roller 42 using the ratchet 46 is released, and the winding roller 43 rotates using a driving force which is transmitted through the power transmission mechanism 35 from the driving motor 34. Thereafter, a portion of the wiping member 40 into which liquid has not been absorbed yet is fed from the feeding roller 42, and a portion of the wiping member 40 into which liquid has been absorbed is wound around the winding roller 43.

Subsequently, when the control unit 50 causes the driving motor 34 to be driven in the second direction after the carriage 17 is moved from the wiping position, the holding unit 37 performs a homeward movement in the transport direction Y toward the movement start position Ps from the movement end position Pe. In this manner, wiping which is one of the maintenance operations of the liquid ejecting unit 22 using the wiper unit 30 is completed.

Subsequently, the first wiping which is wiping performed by the liquid ejecting apparatus 11 after ejecting liquid of which a flight distance is the first distance PG1 will be described.

In the first wiping, the control unit 50 successively executes the former movement operation in which the holding unit 37 is moved at the movement speed VW0, the first wiping operation in which the holding unit 37 is moved at the first speed VW1, and the latter movement operation in which the holding unit 37 is moved at the movement speed VW0.

First, in the former movement operation, the wiping member 40 and the liquid ejecting unit 22 relatively move at the movement speed VW0 by moving the wiping portion 40*a* from the movement start position Ps to the contact start position Pc, in a state in which the liquid ejecting unit 22 and the wiping member 40 are separated from each other (movement process).

Subsequently, as the first wiping operation, as illustrated in FIG. 4B, the wiping member 40 and the liquid ejecting unit 22 relatively move at the first speed VW1 by moving the wiping portion 40*a* from the contact start position Pc to the contact end position Pd, in a state in which the liquid ejecting unit 22 and the wiping member 40 are caused to come into contact with each other (first wiping process).

In addition, in the latter wiping operation, the wiping member 40 and the liquid ejecting unit 22 relatively move at the movement speed VW0 by moving the wiping portion 40*a* from the contact end position Pd to the movement end position Pe in a state in which the liquid ejecting unit 22 and the wiping member 40 are separated from each other (movement process).

Subsequently, the second wiping which is wiping performed by the liquid ejecting apparatus 11 after ejecting liquid of which a flight distance is the second distance PG2 will be described.

In the second wiping, the control unit 50 successively executes the former movement operation in which the holding unit 37 is moved at the movement speed VW0, the second wiping operation in which the holding unit 37 is moved at the second speed VW2, and the latter movement operation in which the holding unit 37 is moved at the movement speed VW0.

First, in the former movement operation, the wiping member 40 and the liquid ejecting unit 22 relatively move at the movement speed VW0 by moving the wiping portion 40*a* from the movement start position Ps to the contact start position Pc, in a state in which the liquid ejecting unit 22 and the wiping member 40 are separated from each other (movement process).

Subsequently, as the second wiping operation, as illustrated in FIG. 4B, the wiping member 40 and the liquid ejecting unit 22 relatively move at the second speed VW2 by moving the wiping portion 40*a* from the contact start position Pc to the contact end position Pd, in a state in which the liquid ejecting unit 22 and the wiping member 40 are caused to come into contact with each other (second wiping process).

In addition, in the latter movement operation, the wiping member 40 and the liquid ejecting unit 22 relatively move at the movement speed VW0 by moving the wiping portion 40*a* from the contact end position Pd to the movement end position Pe, in a state in which the liquid ejecting unit 22 and the wiping member 40 are separated from each other (movement process).

Subsequently, an operation of the liquid ejecting apparatus 11 which is configured as described above will be described.

When a flight distance of liquid before performing wiping is relatively short (case of first distance PG1), the control unit 50 selects the first wiping. Then, a wiping operation is executed while the opening face 22*a* and the wiping portion 40*a* relatively moves at the first speed VW1, since the holding unit 37 move at a relatively high speed (first speed VW1) in the contact region Ac.

On the other hand, when a flight distance of liquid before performing wiping is long (case of second distance PG2), the control unit 50 selects the second wiping. Then, a wiping operation is executed while the opening face 22*a* and the wiping portion 40*a* relatively move at the second speed VW2 which is lower than the first speed VW1, since the holding unit 37 moves at a relatively low speed (second speed VW2) in the contact region Ac. That is, when it is expected that an amount of liquid which is attached to the opening face 22*a* of the liquid ejecting unit 22 is large, the wiping operation is performed at the lower speed. For this reason, it is possible to reliably absorb liquid using the wiping operation even when the amount of liquid which is attached to the opening face 22*a* is large.

In addition, since the wiping portion 40*a* moves at the movement speed VW0 which is higher than the first speed VW1 and the second speed VW2 in the movement operations in the non-contact regions Ads and Ade which are successively performed before and after such a wiping operation, it is possible to reduce the time which is necessary for wiping compared to a case in which a movement speed of the wiping portion 40*a* is not changed between the contact region Ac and the non-contact regions Ads and Ade.

According to the embodiment, it is possible to obtain the following effect.

(1) When the second wiping operation is selected, it is possible to improve a wiping performance compared to a case in which the first wiping operation is selected, since the wiping member 40 and the liquid ejecting unit 22 relatively move at the second speed VW2 which is lower than the first speed VW1. On the other hand, it is possible to reduce the time which is necessary for wiping compared to a case in which the movement operation is performed at the second speed VW2 since the movement operation which does not accompany wiping-off of the liquid ejecting unit 22 is performed at the movement speed which is higher than the second speed VW2. Accordingly, it is possible to efficiently perform wiping so that the time which is necessary for wiping does not become excessively long, while improving a wiping performance.

(2) When the second wiping is selected, it is possible to improve a wiping performance compared to a case in which the first wiping is selected, since the wiping member 40 and the liquid ejecting unit 22 relatively move at the second speed VW2 which is lower than the first speed VW1 in the wiping operation. In addition, since the liquid ejecting unit 22 and the wiping member 40 relatively move at the movement speed VW0 which is higher than the first speed VW1 in the movement operation of the first wiping and the second wiping, it is possible to reduce the time which is necessary for wiping compared to a case in which the movement operation is performed at the first speed VW1, or the second speed VW2.

(3) When a flight distance of liquid is the second distance PG2 which is longer than the first distance PG1, there is a high possibility that mist which accompanies the ejecting of liquid increases, and an amount of liquid which is attached to the opening face 22*a* increases compared to a case in which a flight distance of liquid is the first distance PG1. In that point, according to the embodiment, it is possible to more reliably wipe liquid compared to a case in which a large amount of liquid is attached to the opening face 22*a*, since the second wiping operation of which the relative movement speed is lower than the first wiping operation is performed when the flight distance is the second distance PG2.

(4) When a flight distance of liquid is long, a relative movement speed VW between the liquid ejecting unit 22 and the wiping member 40 in the wiping operation becomes low compared to a case in which a flight distance of liquid is short. That is, when it is expected that the amount of liquid which is attached to the opening face 22*a* of the liquid ejecting unit 22 is large, the relative movement speed VW between the opening face 22*a* and the wiping member 40 when performing a wiping operation becomes low, compared to a case in which it is expected that the amount of liquid which is attached to the opening face is small. For this reason, liquid which is absorbed from the opening face 22*a* easily permeates the permeation portion 40*b* which is a non-contact portion from the wiping portion 40*a* which is a portion which comes into contact with the opening face 22*a* even in a case in which a large amount of liquid is attached to the opening face 22*a* of the liquid ejecting unit 22. As a result, even when the amount of liquid which is attached to the opening face 22*a* is large, it is possible to suppress intruding of liquid or foreign substances into the nozzle 24 when the wiping member 40 performs the wiping operation.

(5) When a flight distance of liquid is short, the relative movement speed VW between the liquid ejecting unit 22 and the wiping member 40 when performing the wiping operation becomes high, compared to a case in which a flight distance of liquid is long. That is, when it is expected that the amount of liquid which is attached to the opening face 22*a* of the liquid ejecting unit 22 is small, the relative movement speed VW between the opening face 22*a* and the wiping member 40 when performing the wiping operation becomes high, compared to a case in which it is expected that the amount of liquid which is attached to the opening face of the liquid ejecting unit is large. For this reason, when only a small amount of liquid is attached to the opening face 22*a* of the liquid ejecting unit 22, it is possible to reduce the time which is necessary for the wiping operation.

Second Embodiment

Subsequently, a second embodiment of the liquid ejecting apparatus will be described with reference to drawings.

In the following description of the second embodiment, the same constituent elements as those in the first embodiment will be given the same reference numerals, descriptions thereof will be omitted, and different points from those in the first embodiment will be mainly described.

In a liquid ejecting apparatus 11 according to the embodiment, a flight distance of liquid (interval PG) when ejecting liquid from a liquid ejecting unit 22 is changed in three stages (first distance PG1, second distance PG2, third distance PG3, and PG1<PG2<PG3) according to the type or the thickness of a medium P.

Figure 9:
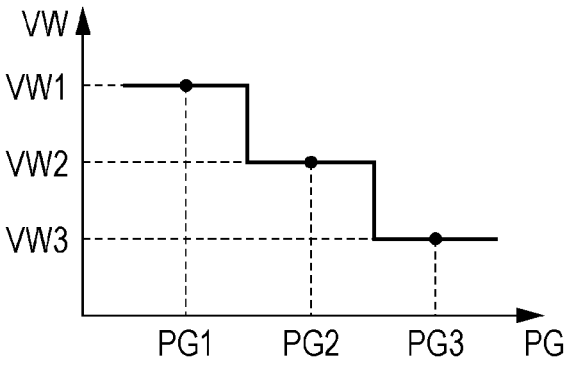
FIG. 9 is a graph which illustrates a relationship between an interval and a moving speed according to a second embodiment.

In addition, as illustrated in FIG. 9, a relative movement speed VW between the liquid ejecting unit 22 and the wiping member 40 in an wiping operation is set in three stages (first speed VW1, second speed VW2, third speed VW3, and VW1>VW2>VW3) in wiping after ejecting of liquid, according to the interval PG (PG1, PG2, PG3) when ejecting liquid from the liquid ejecting unit 22. In addition, wiping with wiping operations in a contact region Ac which are performed at the first speed VW1, the second speed VW2, and the third speed VW3 is referred to as first wiping, second wiping, and third wiping, respectively.

That is, in the wiping operation of the first wiping, the opening face 22*a* is wiped off by causing the wiping member 40 and the liquid ejecting unit 22 to relatively move at the first speed VW1 in a state in which the opening face 22*a* and the wiping member 40 are caused to come into contact with each other (first wiping process). In addition, in the wiping operation of the second wiping, the opening face 22*a* is wiped off by causing the wiping member 40 and the liquid ejecting unit 22 to relatively move at the second speed VW2 which is lower than the first speed VW1 in a state in which the opening face 22*a* and the wiping member 40 are caused to come into contact with each other (second wiping process). In addition, in the wiping operation of the third wiping, the opening face 22*a* is wiped off by causing the wiping member 40 and the liquid ejecting unit 22 to relatively move at the third speed VW3 which is lower than the first speed VW1 and the second speed VW2 in a state in which the opening face 22*a* and the wiping member 40 are caused to come into contact with each other (third wiping process).

In addition, in the first wiping, the second wiping, and the third wiping, the holding unit 37 is caused to move in the wiping direction at the first speed VW1 which is higher than the second speed VW2 and the third speed VW3 in the movement operation in the non-contact regions Ads and Ade (movement process).

That is, the control unit 50 performs the first wiping by successively executing the former movement operation in which the relative movement between the wiping member 40 and the liquid ejecting unit 22 is caused to be executed at the first speed VW1, the first wiping operation in which the relative movement is caused to be executed at the first speed VW1, and the latter movement operation in which the relative movement is caused to be executed at the first speed VW1. In addition, the control unit 50 performs the second wiping by successively executing the former movement operation in which the relative movement between the wiping member 40 and the liquid ejecting unit 22 is caused to be executed at the first speed VW1, the second wiping operation in which the relative movement is caused to be executed at the second speed VW2, and the latter movement operation in which the relative movement is caused to be executed at the first speed VW1. In addition, the control unit 50 performs the third wiping by successively executing the former movement operation in which the relative movement between the wiping member 40 and the liquid ejecting unit 22 is caused to be executed at the first speed VW1, the third wiping operation in which the relative movement is caused to be executed at the third speed VW3, and the latter movement operation in which the relative movement is caused to be executed at the first speed VW1.

Subsequently, an operation of the liquid ejecting apparatus 11 according to the second embodiment will be described.

When a flight distance of liquid before performing wiping is the first distance PG1 which is minimum, the wiping portion 40*a* wipes off the opening face 22*a* while moving at the first speed VW1, since the holding unit 37 moves at a relatively high speed (first speed VW1) in the contact region Ac.

On the other hand, when a flight distance of liquid before performing wiping is the third distance PG3 which is maximum, the wiping portion 40*a* wipes off the opening face 22*a* while moving at the third speed VW3, since the holding unit 37 moves at a relatively low speed (third speed VW3) in the contact region Ac. That is, when it is expected that the amount of liquid which is attached to the opening face 22*a* of the liquid ejecting unit 22 is large, a wiping operation is performed at the lower speed.

In addition, when a flight distance of liquid before performing wiping is the second distance PG2, the wiping portion 40*a* wipes off the opening face 22*a* while moving at the second speed VW2 between the first speed VW1 and the third speed VW3 in the contact region Ac.

For this reason, also in a case in which a large amount of liquid is attached to the opening face 22*a*, it is possible to reliably absorb liquid in a wiping operation using the wiping portion 40*a*. In addition, since the wiping portion 40*a* moves at the first speed VW1 which is a high speed in the movement operations in the non-contact regions Ads and Ade which are consecutive before and after the wiping operation, it is possible to reduce the time which is necessary for wiping compared to a case in which a movement speed of the wiping portion 40*a* is not changed between the contact region Ac and the non-contact regions Ads and Ade.

In addition, according to the embodiment, it is possible to obtain the following effect in addition to the effects (1) and (3) to (5).

(6) When the second wiping is selected, since the wiping member 40 and the liquid ejecting unit 22 relatively move at the second speed VW2 which is lower than the first speed VW1 in the wiping operation, it is possible to improve a wiping performance compared to a case in which the first wiping is selected. In addition, since the liquid ejecting unit 22 and the wiping member 40 relatively move at the first speed VW1 in the movement operation of the second wiping, it is possible to simplify a control of the movement mechanism 38.

(7) When the third wiping is selected, since the wiping member 40 and the liquid ejecting unit 22 relatively move at the third speed VW3 which is lower than the first speed VW1 and the second speed VW2 in the wiping operation, it is possible to improve the wiping performance compared to a case in which the first wiping is the second wiping is selected. In addition, since the liquid ejecting unit 22 and the wiping member 40 relatively move at the first speed VW1 in the movement operation of the third wiping, it is possible to simplify the control of the movement mechanism 38.

Third Embodiment

Subsequently, a liquid ejecting apparatus according to a third embodiment will be described with reference to drawings.

In the following descriptions of the third embodiment, the same constituent elements as those in the first embodiment will be given the same reference numerals, descriptions thereof will be omitted, and different points from those in the first embodiment will be mainly described.

Figure 10:
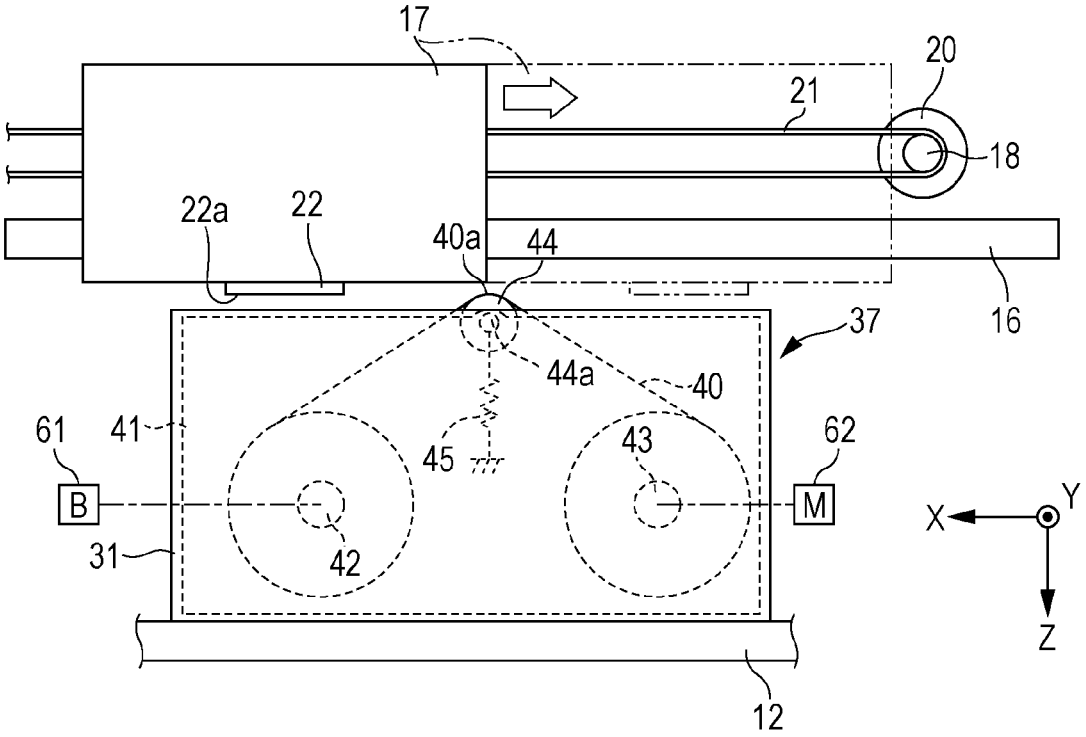
FIG. 10 is a front view which illustrates a schematic configuration of a wiper unit according to a third embodiment.

As illustrated in FIG. 10, a holding unit 37 which is included in a wiper unit 30 according to the third embodiment is arranged so that a longitudinal direction thereof is parallel to the scanning direction X, and includes a wiper holder 31 which is arranged so as to be fixed to a frame 12 of a liquid ejecting apparatus 11, and a wiper cassette 41 which is detachably mounted on the wiper holder 31. In addition, an axial direction of each roller 42, 43, and 44 which is pivotally supported by the wiper cassette 41 is parallel to a transport direction Y in a state in which the wiper cassette 41 is mounted on the wiper holder 31.

A brake system 61 which regulates or allows a rotation of a feeding roller 42 in the feeding direction (clockwise in FIG. 10) is provided in a holding unit 37. The brake system 61 is connected to an input-output interface of a control unit 50, and the control unit 50 adjusts a magnitude of a braking force of the brake system 61 which is applied to the feeding roller 42.

A winding roller 43 is configured so as to rotate in the winding direction (clockwise in FIG. 10) due to a driving force of a winding motor 62. The winding motor 62 is connected to the input-output interface of the control unit 50, and the control unit 50 changes a rotation amount of the winding motor 62.

In addition, according to the embodiment, wiping is performed in a process in which a carriage 17 moves from a movement start position Ps (position denoted by solid line in FIG. 10) which is set on a side opposite to a home position (left side in FIG. 10) compared to the holding unit 37 in the scanning direction X to a movement end position Pe (position denoted by two-dot dash line in FIG. 10) which is set on a side of the home position (right side in FIG. 10) compared to the holding unit 37.

In the wiping, the former movement operation in which the liquid ejecting unit 22 is moved in the non-contact region Ads, a wiping operation in which the liquid ejecting unit 22 is moved in the contact region Ac, and the latter movement operation in which the liquid ejecting unit 22 is moved in the non-contact region Ade are successively executed.

Figure 11A:
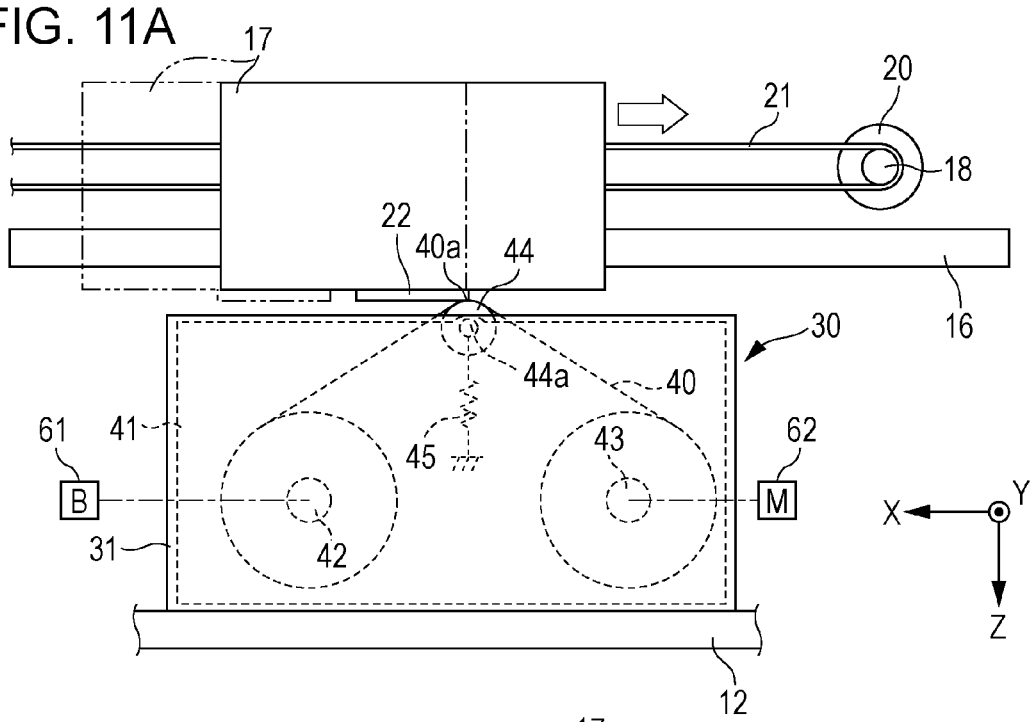
FIGS. 11A to 11C are schematic diagrams which describe a wiping operation according to the third embodiment.
Figure 11B:
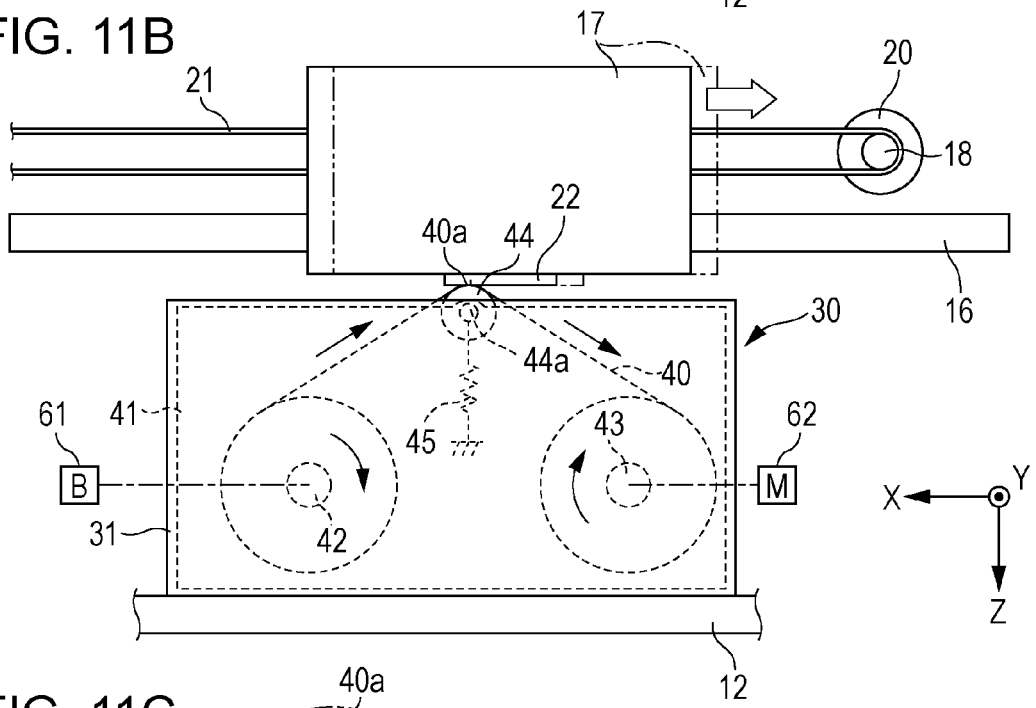

According to the embodiment, the non-contact region Ads is a region from the movement start position Ps which is denoted by a two-dot dash line in FIG. 11A to a contact start position Pc which is denoted by a solid line in FIG. 11A, and the contact region Ac is a region from the contact start position Pc to a contact end position Pd which is denoted by a two-dot dash line in FIG. 11B. In addition, the non-contact region Ade is a region from the contact end position Pd to a movement end position Pe which is denoted by a two-dot dash line in FIG. 10.

According to the embodiment, a relative movement direction between the liquid ejecting unit 22 and the wiping member 40 (wiping direction denoted by outline arrow in FIGS. 10 to 11B) when performing wiping is a direction which intersects a formation direction of each nozzle column 25 of the liquid ejecting unit 22, that is, which is parallel to the scanning direction X.

In addition, according to the embodiment, a "movement mechanism" is configured of pulleys 18 and 19, a carriage motor 20, and a timing belt 21, in order to cause the wiping member 40 and the liquid ejecting unit 22 to relatively move by moving the carriage 17 with respect to the holding unit 37 which does not move.

In addition, when wiping is not performed, it is preferable to cause the wiping portion 40*a* to retreat to a position at which the wiping portion 40*a* and the liquid ejecting unit 22 do not come into contact with each other by releasing urging of an urging member 45, or the like, for example, so that the liquid ejecting unit 22 and the wiping member 40 do not come into contact with each other along with a movement of the carriage 17. Alternatively, a position of the liquid ejecting unit 22 in height may be adjusted using an adjusting mechanism 15 so that the liquid ejecting unit 22 and the wiping portion 40*a* do not come into contact with each other.

Meanwhile, when the amount of liquid which is attached to the opening face 22*a* is large, it is preferable to set a movement speed VW when performing a wiping operation to be low, or to set a portion of the wiping member 40 which is in a state of not absorbing liquid to a new wiping portion 40*a* by moving the wiping portion 40*a* which has absorbed liquid, by winding up the wiping member 40 in the middle of the wiping operation.

Therefore, according to the embodiment, when a flight distance of liquid is long, a winding operation of winding the wiping portion 40*a* around the winding roller 43 is performed by rotating the winding roller 43 in the winding direction (clockwise in FIGS. 10 and 11) in addition to performing a movement of the liquid ejecting unit 22 in the wiping operation at a low speed.

In addition, when a flight distance of liquid is particularly long, a winding amount QW of the wiping member 40 when performing a wiping operation is set to be large by setting a rotation amount of the winding roller 43 while the liquid ejecting unit 22 moves in the contact region Ac to be large. In addition, according to the embodiment, the winding amount QW of the wiping member 40 may be calculated by detecting a rotation amount of the press roller 44, for example, using a rotation amount detecting equipment such as a rotary encoder, or the like, and according to a detected value thereof.

Figure 12A:
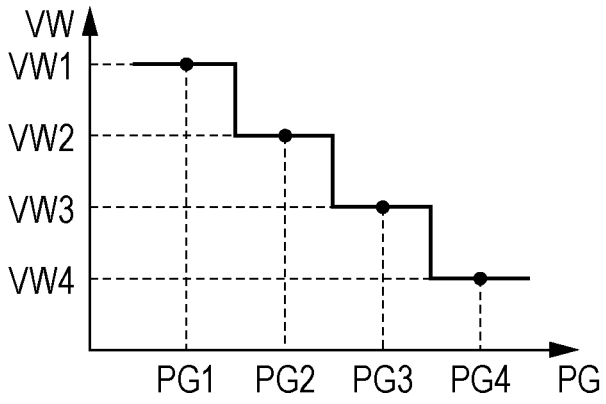
FIG. 12A is a graph which illustrates a relationship between an interval and a moving speed in the third embodiment.

As illustrated in FIG. 12A, in the liquid ejecting apparatus 11 according to the embodiment, the interval PG when liquid is ejected from the liquid ejecting unit 22 is changed into four stages (first distance PG1, second distance PG2, third distance PG3, fourth distance PG4, and PG1<PG2<PG3<PG4) according to the type or the thickness of a medium P.

In addition, in wiping which is performed after ejecting liquid, it is possible to select a relative movement VW between the liquid ejecting unit 22 and the wiping member 40 in the wiping operation from four stages (first speed VW1, second speed VW2, third speed VW3, fourth speed VW4, and VW1>VW2>VW3>VW4), according to the interval PG when ejecting liquid from the liquid ejecting unit 22. In addition, wiping with the wiping operation in the contact region Ac performed at the first speed VW1, the second speed VW2, the third speed VW3, and the fourth speed VW4 is referred to as first wiping, second wiping, third wiping, and fourth wiping, respectively.

In addition, according to the embodiment, the control unit 50 sets a speed of the relative movement to be high after the contact between the wiping member 40 and the nozzle 24 ends in the wiping operation in the contact region Ac. That is, the movement speed VW of the carriage in the former movement operation and in the wiping operation are the same; however, the movement speed VW of the carriage 17 is set to be high in the latter movement operation compared to that in the wiping operation, since the carriage 17 starts an acceleration at the last portion of the wiping operation at which a contact between the wiping member 40 and the nozzle 24 ends.

As a result, in the first wiping, the second wiping, the third wiping, and the fourth wiping, the latter movement operation is executed at a high speed, respectively, compared to the first speed VW1, the second speed VW2, the third speed VW3, and the fourth speed VW4 which are the movement speed VW of the carriage 17 in the wiping operation.

In addition, the movement speed VW of the carriage 17 may be continuously increased after the liquid ejecting unit 22 is separated from the wiping member 40, and starting of the increment when the contact between the wiping member 40 and the nozzle 24 ends, or the carriage may perform an equal speed movement at a constant movement speed VW which is higher than the movement speed VW in the wiping operation, after the liquid ejecting unit 22 is separated from the wiping member 40.

Figure 12B:
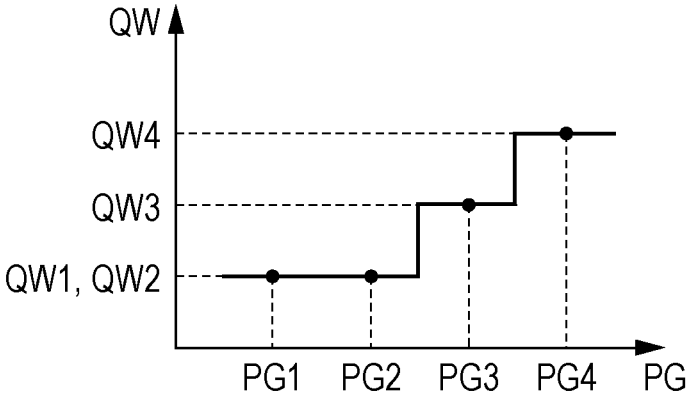
FIG. 12B is a graph which illustrates a relationship between an interval and a winding amount of the wiping member in the third embodiment.

In addition, as illustrated in FIG. 12B, according to the embodiment, the winding amount QW of the wiping member 40 (QW1, QW2, QW3, and QW4) in the subsequent wiping operation is changed according to the interval PG at the time of ejecting liquid. Specifically, when the interval PG is the first distance PG1 or the second distance PG2, winding is not performed (QW1=QW2=0), when the interval PG is the third distance PG3, the winding amount QW is set to QW3 (QW3>0), and when the interval PG is the fourth distance PG4, the winding amount QW is set to QW4 (QW4>QW3).

In this manner, according to the embodiment, the longer the flight distance of liquid, the larger the rotation amount of the winding roller 43 in a wiping operation. In addition, when the interval PG at the time of ejecting liquid is the first distance PG1 or the second distance PG2, a braking force is applied to the feeding roller 42 using the brake system 61 in order to regulate feeding of the wiping member 40 in the wiping operation.

Subsequently, wiping which is performed by the liquid ejecting apparatus 11 according to the third embodiment will be described.

When wiping is performed in the liquid ejecting apparatus 11 according to the embodiment, first, the carriage motor 20 is driven, and the carriage 17 is arranged at the movement start position Ps which is denoted by the two-dot dash line in FIG. 11A.

In addition, as illustrated in FIG. 11A, by moving the carriage 17 from the movement start position Ps to the contact start position Pc which is denoted by a solid line in the figure, the former movement operation is performed. When the carriage 17 reaches the contact start position Pc, an end portion of the opening face 22*a* of the liquid ejecting unit 22 which is supported by the carriage 17 comes into contact with the wiping portion 40*a* of the wiping member 40. At this time, the wiping member 40 is pressed against the opening face 22*a* by the press roller 44 which is urged by the urging member 45.

Subsequently, when the carriage 17 moves from the contact start position Pc to the contact end position Pd which is denoted by a two-dot dash line in FIG. 11B, the wiping operation of wiping off the opening face 22*a* using the wiping portion 40*a* is performed. That is, when the opening face 22*a* of the liquid ejecting unit 22 which is supported by the carriage 17 comes into contact with the wiping member 40 in the contact region Ac, liquid which is attached to the opening face 22*a* is wiped off.

In addition, when the carriage 17 reaches a position at which a contact between the wiping portion 40*a* and the nozzles 24 ends (position denoted by solid line in FIG. 11B), the carriage moves to the movement end position Pe with the movement speed VW gradually increased. As a result, the relative movement between the liquid ejecting unit 22 and the wiping member 40 in the latter movement operation is executed at a speed higher than that of the relative movement between the liquid ejecting unit 22 and the wiping member 40 in the wiping operation.

In addition, after the carriage 17 reaches the movement end position Pe, maintenance of the liquid ejecting unit 22 using the wiper unit 30 is completed by retreating the wiping portion 40*a*, and moving the carriage 17 to the home position, or the like.

Subsequently, first wiping and second wiping which are performed by the liquid ejecting apparatus 11 after ejecting of liquid of which flight distances of liquid are the first distance PG1 and the second distance PG2, respectively will be described.

In the first wiping and the second wiping, the control unit 50 moves the carriage 17 at the first speed VW1 and the second speed VW2, respectively, from the movement start position Ps. In addition, the control unit performs wiping-off of the opening face 22*a* using the wiping portion 40*a* as a wiping operation in the contact region Ac, by causing the carriage 17 to continuously move at the first speed VW1 and the second speed VW2, even after the opening face 22*a* of the liquid ejecting unit 22 comes into contact with the wiping portion 40*a* (first wiping process and second wiping process).

In addition, in the wiping operations of the first wiping and the second wiping, a winding amount QW1 of the wiping member 40 becomes "0" since a rotation of the feeding roller 42 is regulated by the brake system 61.

In addition, when the contact between the wiping portion 40*a* and the nozzle 24 ends at a position which is denoted by a solid line in FIG. 11B, the carriage 17 increases the movement speed VW, and rapidly performs the latter movement operation at a speed which is higher than the first speed VW1 or the second speed VW2 (movement process).

Subsequently, the third wiping and the fourth wiping which are performed by the liquid ejecting apparatus 11 after ejecting of liquid of which flight distances of liquid are the third distance PG3 and the fourth distance PG4, respectively, will be described.

In the third wiping and the fourth wiping, the control unit 50 moves the carriage 17 at the third speed VW3 and the fourth speed VW4, respectively, from the movement start position Ps. In addition, the control unit performs wiping-off of the opening face 22*a* using the wiping portion 40*a* as a wiping operation in the contact region Ac, by causing the carriage 17 to continuously move at the third speed VW3 and the fourth speed VW4, even after the opening face 22*a* of the liquid ejecting unit 22 comes into contact with the wiping portion 40*a* (third wiping process and fourth wiping process).

A winding operation of winding the wiping portion 40*a* around the winding roller 43 is performed by rotating the winding roller 43 in the winding direction by controlling the winding motor 62 by the control unit 50 in the middle of wiping operations of the third wiping and the fourth wiping. In addition, with regard to the winding amount QW of the wiping member 40 in the middle of the wiping operation, the winding amount QW4 in the fourth wiping is larger than the winding amount QW3 in the third wiping.

Figure 11C:
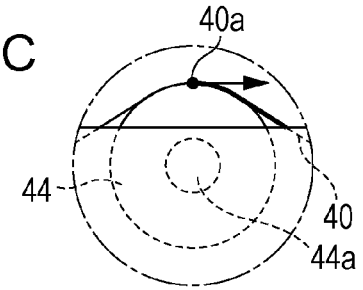

Then, as denoted by an arrow in FIG. 11C, the wiping portion 40*a* which absorbed liquid is wound around the winding roller 43 while moving in the same direction as the wiping direction, and a portion of the wiping member 40 which is not used yet becomes a new wiping portion 40*a*. In this manner, it is possible to absorb liquid in the wiping member 40 in an area larger than the wiping portion 40*a* which is originally in contact with the opening face 22*a* in the wiping operation, by winding up the wiping member 40.

In addition, a braking force is applied to the feeding roller 42 using the brake system 61 in order to regulate feeding of the wiping member 40 which is accompanied by a contact with the opening face 22*a* while allowing feeding of the wiping member 40 which is accompanied by a rotation of the winding roller 43 while the wiping operation is performed. For this reason, the wiping member 40 is prevented from being unintentionally fed due to a friction force which is applied due to the contact with the opening face 22*a*. In addition, the braking force which is applied to the feeding roller 42 by the brake system 61 is larger than the friction force which is applied to the wiping member 40 accompanied by the contact with the opening face 22*a* and is smaller than tension applied to the wiping member 40 due to the rotation of the winding roller 43.

In addition, when the contact between wiping portion 40*a* and the nozzle 24 which is denoted by a solid line in FIG. 11B ends, the carriage 17 increases the movement speed VW, and rapidly performs the latter movement operation at a speed higher than the third speed VW3 or the fourth speed VW4 (movement operation).

Subsequently, an operation of the liquid ejecting apparatus 11 according to the embodiment will be described.

According to the embodiment, a flight distance of liquid at a time of printing is set in four stages, and when it is expected that the amount of liquid which is attached to the opening face 22*a* of the liquid ejecting unit 22 is large, a relative movement speed between the liquid ejecting unit 22 and the wiping member 40 is changed so that an wiping operation is performed at a low speed according to a flight distance thereof. For this reason, even when the amount of liquid which is attached to the opening face 22*a* is large, it is possible to reliably absorb liquid using the wiping operation of the wiping portion 40*a*.

In such a wiping operation, the carriage 17 gradually increases the movement speed VW, and move to the movement end position Pe after ending of the contact between the wiping portion 40*a* and the nozzle 24. For this reason, it is possible to reduce the time necessary for wiping by rapidly moving the carriage 17 to the movement end position Pe after absorbing liquid which is attached to the vicinity of the opening of the nozzle 24, or liquid in the nozzle 24 into the wiping member 40.

In addition, since the carriage 17 moves at the same movement speed VW as that in the wiping operation in the former movement operation, it is possible to reduce a shock when the liquid ejecting unit 22 and the wiping member 40 come into contact with each other compared to a case in which the movement speed VW of the carriage 17 in the non-contact region Ads is higher than the movement speed VW in the contact region Ac.

In addition, the control unit 50 performs the winding operation of winding the wiping portion 40*a* around the winding roller 43 by rotating the winding roller 43 in the winding direction in the middle of the wiping operation. In addition, at this time, the longer the flight distance of liquid, the larger the rotation amount of the winding roller 43 in the middle of the wiping operation.

In this manner, liquid is likely to permeate the permeation portion 40*b* which is not in contact with the opening face 22*a* from the wiping portion 40*a*, before the wiping portion 40*a* which is in contact with the opening face 22*a* absorbs liquid to the maximum limit. For this reason, it is possible to prevent the opening face 22*a* from being wiped off by the wiping portion 40*a* in a state of absorbing liquid to the maximum limit. That is, even in a case in which the amount of liquid attached to the opening face 22*a* is large, it is possible to suppress intruding of liquid or foreign substances into the nozzle 24 when the wiping member 40 performs wiping.

In addition, a movement direction in which the wiping portion 40*a* moves in the middle of the wiping operation along with winding up of the wiping member 40 is the same direction as the relative movement direction (wiping direction) of the liquid ejecting unit 22 with respect to the holding unit 37. For this reason, a friction force which is generated due to a relative contact between the opening face 22*a* of the liquid ejecting unit 22 and the wiping member 40 becomes small, and a friction force which acts between the opening face 22*a* and the wiping member 40 is reduced.

According to the above described third embodiment, it is possible to obtain the following effects, in addition to the effects (1), and (3) to (5).

(8) When a flight distance of liquid which is ejected from the liquid ejecting unit 22 is long, there is a high possibility that the amount of mist generated which accompanies ejecting of liquid may increase, and the amount of liquid which is attached to the opening face 22*a* may increase. In that point, it is possible to suppress deterioration in liquid absorbing ability using the wiping member 40 which is formed of a liquid absorbing member, since a rotation amount of the winding roller 43 in the wiping operation becomes larger, as a flight distance of liquid becomes longer.

(9) Since a relative movement speed when the wiping member 40 and the nozzle 24 come into contact with each other in the wiping operation becomes low compared to a relative movement speed after the contact between the wiping member 40 and the nozzle 24 ends, it is possible to reliably absorb liquid in the vicinity of the opening of the nozzle 24 using the wiping member 40. In addition, it is possible to reduce the time necessary for wiping by increasing a relative movement speed after the contact between the wiping member 40 and the nozzle 24 ends.

(10) Since a position at which the wiping portion 40*a* comes in contact with the opening face 22*a* can be changed by rotating the winding roller 43 in the winding direction in the middle of executing the wiping operation, it is possible to suppress deterioration in liquid absorbing ability using the wiping member 40 which is formed of the liquid absorbing member.

(11) It is possible to reduce a friction force which is generated when the wiping member 40 wipes off the opening face 22*a* compared to a case in which the movement direction of the wiping portion 40*a* and the wiping direction intersect each other in the winding operation, or a case in which the movement direction of the wiping portion 40*a* become a direction opposite to the wiping direction in the winding operation, since the wiping portion 40*a* moves in the wiping direction in the winding operation.

(12) In the former movement operation, by setting the same relative movement speed as that of the wiping operation, it is possible to reduce a shock which occurs when the liquid ejecting unit 22 and the wiping portion 40*a* come into contact with each other.

(13) When the flight distance of liquid is the third distance PG3 and the fourth distance PG4 which are longer than the first distance PG1 and the second distance PG2, that is, when it is expected that the amount of liquid which is attached to the opening face 22*a* is large, winding of the wiping member 40 is performed while the wiping operation is performed. For this reason, when the flight distance of liquid is long, it is possible to enlarge a contact area of the wiping member 40 with which the opening face 22*a* comes into contact. Accordingly, even in a case in which the flight distance of liquid is relatively long, and a large amount of liquid is attached to the opening face 22*a*, it is possible to maintain the liquid ejecting properties of the liquid ejecting unit 22 good by appropriately wiping off liquid.

In addition, the above described embodiment may be changed like the following modification example.

Figure 13:
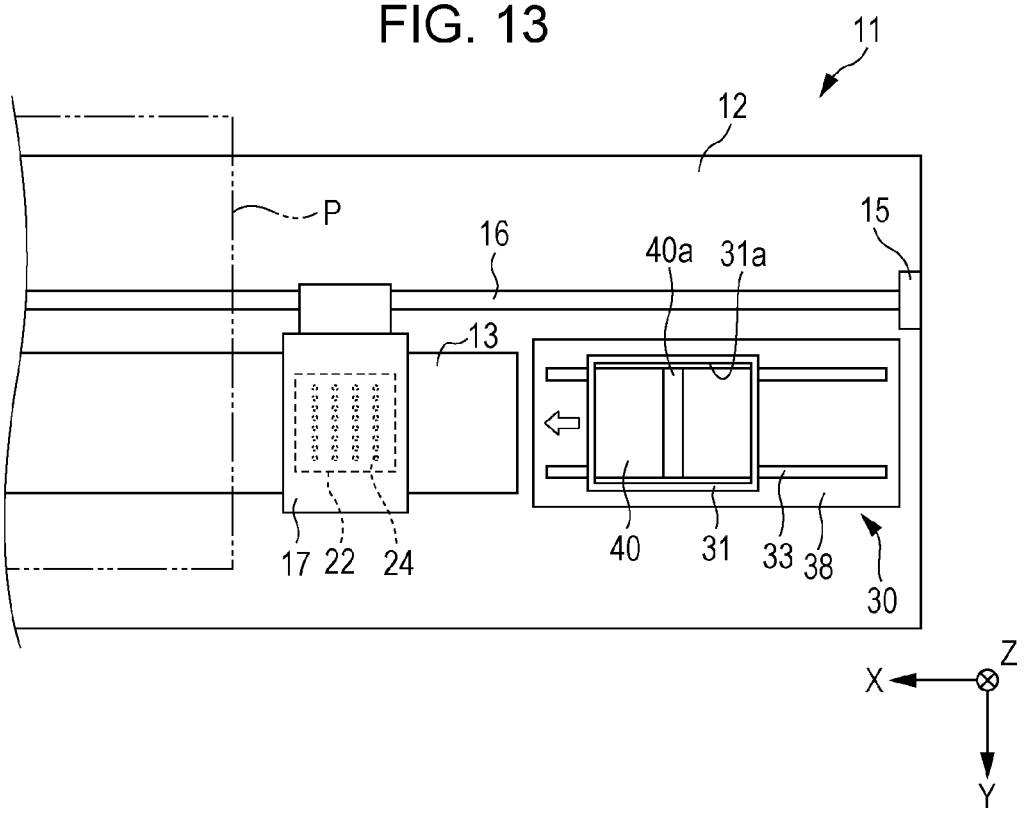
FIG. 13 is a plan view which schematically illustrates a first modification example of the wiper unit.

As a first modification example which is illustrated in FIG. 13, the movement mechanism 38 of the wiper unit 30 may move the holding unit 37 which holds the wiping member 40 along the scanning direction X. In this case, wiping may be performed by moving the holding unit 37 along the scanning direction X using the movement mechanism 38 in a state in which the carriage 17 is stopped at the wiping position, or the wiping may be performed by moving both the carriage 17 and the holding unit 37 along the scanning direction X.

As the first modification example which is illustrated in FIG. 13, the wiping member 40 may be exposed through an opening portion 31*a* in the wiper unit 30 by providing the opening portion 31*a* which is large and of which a longitudinal direction is parallel to the wiping direction (direction which is denoted by outline arrow in FIG. 13) in the holding unit 37. In this case, it is possible to perform flushing in which liquid is ejected toward the wiping member 40 which is exposed through the opening portion 31*a*. According to the configuration, it is possible to perform flushing in the former and latter movement operations of the wiping operation. In addition, when flushing is performed in the former and latter movement operations of the wiping operation, it is possible to rapidly re-shape a meniscus with flushing thereafter, even when the meniscus in the nozzle 24 is collapsed along with the wiping operation.

Figure 14:
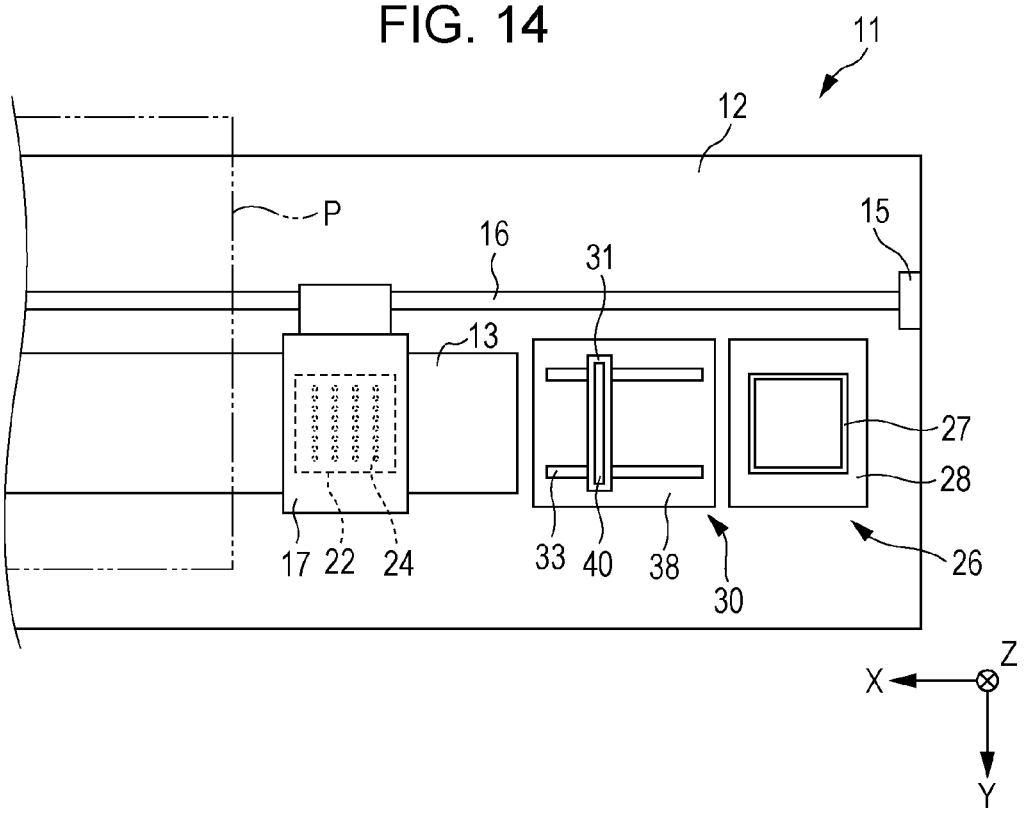
FIG. 14 is a plan view which schematically illustrates a second modification example of the wiper unit.

As in a second modification example which is illustrated in FIG. 14, the wiping member 40 may be configured of a plate shaped member. The plate shaped wiping member 40 may be configured of elastomer which does not absorb liquid, for example, or may be a porous material which can absorb liquid in which a size of a hole thereof is set so as not to hold liquid. In addition, the plate shaped wiping member 40 may be configured so as to move along the scanning direction X using the movement mechanism 38, or may be configured so as to move along the transport direction Y.

Figure 15:
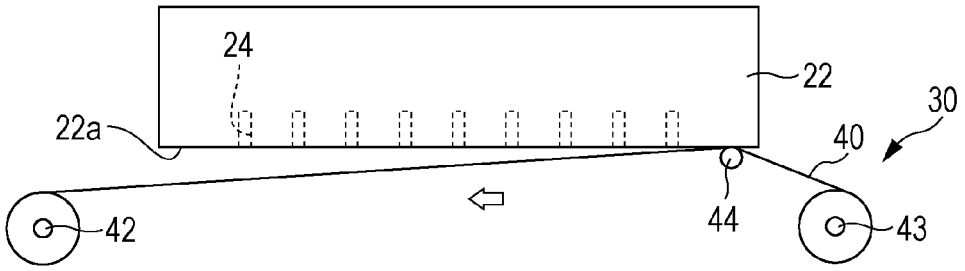
FIG. 15 is a side view which schematically illustrates a third modification example of the wiper unit.

As in a third modification example which is illustrated in FIG. 15, the wiping member 40 may be stretched in a length corresponding to the opening face 22*a* in the wiping direction in the wiper unit 30, and the wiping operation may be performed by moving the press roller 44 in the wiping direction in a state in which the stretched wiping member 40 is interposed between the press roller 44 and the opening faces 22*a*. Alternatively, in the wiper unit 30 in the third modification example, the wiping operation may be performed by moving a moving body which is not a roller in the wiping direction along the wiping member 40.

The first wiping may be selected after executing suctioning cleaning while selecting the second wiping after ejecting liquid (after executing printing). After executing the suctioning cleaning, liquid is attached to a part of a region in the vicinity of the opening of the nozzle 24 in many cases; however, after executing printing, liquid is attached to the entire opening face 22*a* in many cases. For this reason, in the entire opening face 22*a*, an attaching amount of liquid is large after executing printing compared to a case after the execution of the suctioning cleaning in many cases. Accordingly, it is possible to more reliably wipe off liquid by performing the second wiping after executing printing in which an attaching amount of liquid is large.

Wiping may be performed when the carriage 17 moves to the non-printing region in order to make a turn in direction while executing printing with respect to one medium P. In addition, the second wiping in which the movement speed in the wiping operation is low may be executed after completing printing with respect to one medium P, by setting wiping which is performed in the middle of executing printing in this manner to first wiping. In particular, when an ejecting amount of liquid with respect to one medium P is large, an attaching amount of liquid with respect to the opening face 22*a* becomes large in the middle of executing printing, and there is a case in which attached liquid is hung and dropped. For this reason, it is possible to more reliably wipe off liquid on the opening face 22*a* by performing the second wiping after completing printing while preventing liquid from being hung and dropped from the opening face 22*a*, by performing the first wiping in the middle of executing printing with respect to one medium P.

However, when the carriage 17 stops at a wiping position for a predetermined time or more in order to perform wiping in the middle of executing printing, there is a concern that a printing quality may be influenced by a change in coloring, or the like, due to a change in infiltration time or drying time of liquid which is received in the medium P in before and after printing processes thereof. For this reason, a stop time thereof is preferably set to be shorter than the time in which a printing quality is changed if the carriage 17 is stopped in order to perform wiping in the middle of executing printing, or it is preferable to perform wiping without stopping the carriage 17 by causing the wiping direction and the scanning direction X to match each other.

In the first embodiment, the movement speed VW0 may be set to the same speed as the first speed VW1.

In the first and second embodiments, the wiping direction and the transport direction Y may match each other.

In the first and second embodiments, as in the third embodiment, the wiping member 40 may be wound between the wiping operations. In this case, it is preferable to provide components which correspond to the brake system 61 and the winding motor 62 in the third embodiment.

In the second embodiment, the movement speed VW in the movement operation may be set to the movement speed VW0 which is higher than the first speed VW1, the second speed VW2, and the third speed VW3.

In the third embodiment, the wiping direction and the scanning direction X may be caused to match each other.

In the third embodiment, the wiping member 40 may be wound between wiping operations which are performed after ejecting liquid of which a flight distance of liquid is the first distance PG1 or the second distance PG2.

In the third embodiment, the movement speed VW in the wiping operation may be set to be equal in the third wiping and the fourth wiping which are performed after ejecting of liquid of which flight distances are the third distance PG3 and the fourth distance PG4.

In the third embodiment, the movement speed VW may be set to be higher in the third wiping and the fourth wiping which are performed after ejecting of liquid of which the flight distances are the third distance PG3 and the fourth distance PG4, or the winding amount QW may be set to be larger. For example, in the third wiping, wiping may be performed at a speed VW3F which is higher than the third speed VW3 corresponding to the third distance PG3, and with a winding amount QW3F which is larger than the winding amount QW3 corresponding to the third distance PG3. In this case, it is preferable that the movement speed VW3 and VW3F, and winding amounts QW3 and QW3F satisfy the following expression (Expression 1).

$$VW3 \times QW3F = VW3F \times QW3 \quad \text{(Expression 1)}$$

In addition, the above expression (Expression 1) means that the movement speed VW may be set to be high when the winding amount QW of the wiping member 40 at a time of performing a wiping operation is set to be large. In this manner, it is possible to reduce the time necessary for wiping by setting the winding amount QW of the wiping member 40 to be large, or to reduce the winding amount QW of the wiping member 40 by setting the movement speed VW to be low.

In the third embodiment, the winding amount QW of the wiping member 40 may be set so that a movement speed of the liquid ejecting unit 22 in the wiping direction, and a movement speed of the wiping portion 40*a* of the wiping member 40 become approximately the same speed when performing the wiping operations of the third wiping and the fourth wiping.

In the third embodiment, wiping may be performed when the carriage 17 moves to the non-printing region for a change in direction, and moves while performing acceleration or deceleration in the middle of executing printing. In addition, when wiping is performed in the middle of a deceleration movement of the carriage 17, a movement speed when performing the wiping operation is set to be lower than the movement speed when performing the former movement operation, and is gradually decreased in the middle of the wiping operation.

In addition, when wiping is performed in the middle of acceleration movement or deceleration movement of the carriage 17 in the non-printing region, as in the second modification example which is illustrated in FIG. 14, a position at which the wiping member 40 is stopped in the scanning direction X may be changed for each time of performing the second wiping and the first wiping using the movement mechanism 38 which moves the wiping member 40 along the scanning direction X. For example, when performing the second wiping, the position at which the wiping member 40 is stopped is set to a position which is separated from the printing region compared to the position at which the wiping member 40 is stopped when performing the first wiping.

In this case, a relative movement speed in the wiping operation of the second wiping becomes lower than a relative movement speed in the wiping operation of the first wiping. In addition, when the first wiping and the second wiping are performed in the middle of the deceleration movement of the carriage 17, the former movement operation of the carriage 17 is performed at a speed higher than the wiping operation in each wiping. On the other hand, when the first wiping and the second wiping are performed in the middle of the acceleration movement of the carriage 17, the latter movement operation of the carriage 17 is performed at a speed higher than the wiping operation in each wiping.

In the third embodiment, the same motor as the winding motor 62 may be arranged instead of the brake system 61.

The relative movement speed in the latter movement operation may be set to be the same as the relative movement speed in the wiping operation, while setting the relative movement speed in the former movement operation to be higher than the relative movement speed in the wiping operation. In this case, it is possible to suppress fight of liquid when the liquid ejecting unit 22 is separated from the wiping portion 40*a*.

When a region on the opening face 22*a* in which the nozzle 24 is open (region from position denoted by two-dot dash line in FIG. 4B to position denoted by solid line in the figure) is set to the nozzle opening region, and a region on the opening face 22*a* which is the outside of the nozzle opening region is set to a peripheral region, it is preferable to set a relative movement speed in the nozzle opening region to be lower than a relative movement speed in the peripheral region.

According to the configuration, it is possible to more reliably remove an attached matter such as liquid since a time in which liquid in the vicinity of the opening of the nozzle 24, liquid increased in viscosity in the nozzle 24, or the like, come into contact with the wiping member becomes long by setting the relative movement speed between the wiping portion 40*a* and the opening face 22*a* to be low in the nozzle opening region in which the nozzle 24 is open. In addition, it is possible to absorb liquid which is increased in viscosity due to drying in the vicinity of the opening of the nozzle 24 using the wiping portion 40*a*, and to remove the liquid. In contrast to this, in the peripheral region on the opening face 22*a* in which the opening of the nozzle 24 is not opened, it is possible to absorb liquid even in a contact time which is shorter than that of the nozzle opening region, since all have to be done is to secure a time for absorbing liquid which is attached to the surface of the opening face 22*a*.

The wiping member 40 which can absorb liquid may have a long shape, may have a rectangular shape, for example, or may have a roller shape. In this case, it is preferable that the wiping member 40 is provided with a permeation unit 40*b* so that liquid permeates from the wiping portion 40*a*.

The relative movement direction (wiping direction) between the opening face 22*a* and the wiping member 40 when performing wiping may be any direction as long as the direction is extends along the opening face 22*a*. For example, the wiping direction may be a direction which diagonally intersects the scanning direction X (width direction of medium) and the transport direction Y.

The relative movement speed VW between the liquid ejecting unit 22 and the wiping member 40 may be set in five stages or more, or may have a continuous relationship like a linear relationship, for example, with respect to a size of the interval PG. In addition, similarly, the winding amount QW of the wiping member 40 may be set according to the interval PG of two stages, may be set according to the interval PG of four or more stages, or may have a continuous relationship like a linear relationship, for example, with respect to a size of the interval PG.

Liquid which is ejected by the liquid ejecting unit 22 is not limited to ink, and may be a liquid body in which particles of a functional material is dispersed or is mixed in liquid, for example. For example, recording may be performed by ejecting a liquid body which includes a material such as an electrode material or a coloring material (pixel material) which is used when manufacturing a liquid crystal display, an electroluminescence (EL) display, and a surface light emission display in a form of dispersion or solution.

The liquid ejecting apparatus 11 is not limited to a so-called on-carriage type in which the liquid container 23 is mounted on the carriage 17, and may be a so-called off-carriage type in which the liquid containers 23 is mounted on a mounting unit which is provided in the frame 12.

The liquid containers 23 may have a configuration in which a flexible pack which accommodates liquid is accommodated in a rigid case, or may have a configuration in which liquid is directly accommodated in the rigid case.

Liquid may be injected or supplemented through an injection port by providing the injection port through which liquid can be injected into the liquid containers 23. According to the configuration, it is possible to supplement liquid without detaching the liquid containers 23.

The liquid containers 23 may be arranged at the outside of the frame 12, and liquid which is accommodated in the liquid containers 23 may be supplied to the liquid ejecting unit 22 through a supply tube which is connected to the carriage 17. In this case, the liquid containers 23 may be fixed to an outer face of the frame 12, or may be arranged at a position which is separated from the frame 12. According to the configuration, it is possible to continuously perform many more printing jobs by making the liquid containers 23 large, since a size of the liquid containers 23 is not limited by a volume of the frame 12.

In addition, when liquid is supplied to the liquid ejecting unit 22 through a supply tube from the outside of the frame 12, a hole or a notch for passing through the supply tube may be provided in the frame 12. According to the configuration, even when the supply tube which supplies liquid to the liquid ejecting unit 22 from the outside of the frame 12 is formed of a material with low rigidity, it is possible to secure a flow path to the liquid ejecting unit 22 from the liquid container 23 which is arranged at the outer side of the frame 12 by suppressing crush of the supply tube.

The medium P is not limited to a sheet, may be a plastic film, a thin plate material, a panel, or the like, and may be cloth which is used in a printing machine, or the like, or a clothe such as a T-shirt.

The medium P may not be transported using a rotating force of the transport roller, and may be transported in the transport direction Y by moving a pedestal on which the medium P is placed, for example. Alternatively, printing may be performed by moving the frame 12 which holds the liquid ejecting unit 22 in the transport direction Y with respect to the medium P which does not move.

The entire disclosure of Japanese Patent Application No. 2014-155931, filed Jul. 31, 2014 is expressly incorporated by reference herein.

What is claimed is:

1. A liquid ejecting apparatus comprising:

a liquid ejecting unit which has an opening face to which a plurality of nozzles which eject liquid onto a medium are open;

a holding unit which holds a wiping member which can wipe off the opening face;

a movement mechanism which relatively moves the liquid ejecting unit and the wiping member in a wiping direction within a movement region which includes a contact region in which the liquid ejecting unit and the wiping member come into contact with each other, and a non-contact region in which the liquid ejecting unit and the wiping member do not come into contact with each other; and a control unit which successively executing an wiping operation in which the opening face is wiped off by causing the liquid ejecting unit and the wiping member to relatively move in the contact region, and a movement operation in which the liquid ejecting unit and the wiping member are caused to relatively move in the non-contact region while controlling the movement mechanism, wherein the control unit can select, as the wiping operation, between a first wiping operation in which the relative movement is executed at a first speed, and a second wiping operation in which the relative movement is executed at a second speed which is lower than the first speed and execute the movement operation at a speed which is higher than the first speed.

2. The liquid ejecting apparatus according to claim 1, wherein the control unit performs first wiping by successively executing the first wiping operation in which the relative movement is executed at the first speed, and the movement operation in which the relative movement is executed at the first speed, and performs second wiping by successively executing the second wiping operation in which the relative movement is executed at the second speed, and the movement operation in which the relative movement is executed at the first speed.

3. The liquid ejecting apparatus according to claim 1, wherein the control unit performs first wiping by successively executing the first wiping operation in which the relative movement is executed at the first speed, and the movement operation in which the relative movement is executed at a moving speed which is higher than the first speed, and performs second wiping by successively executing the second wiping operation in which the relative movement is executed at the second speed, and the movement operation in which the relative movement is executed at a moving speed which is higher than the first speed.

4. The liquid ejecting apparatus according to claim 1, wherein the wiping member absorbs liquid, and the control unit increases the speed of the relative movement after a contact between the wiping member and the nozzle ends in the second wiping operation.

5. The liquid ejecting apparatus according to claim 1, further comprising:

a support member which can support the medium; and an adjusting mechanism which can adjust a flight distance of liquid which is ejected onto the medium from the nozzle, by changing a distance between the liquid ejecting unit and the support member, wherein, when the flight distance is a first distance, the first wiping operation is selected, and when the flight distance is a second distance which is longer than the first distance, the second wiping operation is selected.

6. The liquid ejecting apparatus according to claim 1, wherein the wiping member is formed of a long liquid absorbing member, wherein the holding unit rotatably holds a feeding roller, a press roller, and a winding roller, wherein, in the wiping operation, a wiping portion of the wiping member which is set between the feeding roller and the winding roller is urged in a direction of facing the opening face by the press roller in a state in which a starting end of the wiping member in a longitudinal direction is wound around the winding roller, and a terminal end of the wiping member in the longitudinal direction is wound around the feeding roller, and wherein the control unit performs a winding operation which winds the wiping portion around the winding roller by rotating the winding roller in a winding direction while executing the wiping operation.

7. The liquid ejecting apparatus according to claim 6, further comprising:

a support member which can support the medium; and an adjusting mechanism which can adjust a flight distance of liquid which is ejected onto the medium from the liquid ejecting unit, by changing a distance between the liquid ejecting unit and the support member, wherein the control unit increases a rotation amount of the winding roller in the wiping operation, as the flight distance becomes longer.

8. The liquid ejecting apparatus according to claim 6, wherein the wiping portion moves in the wiping direction in the wiping operation.

9. A maintenance method comprising:

wiping off an opening face of a liquid ejecting unit to which a plurality of nozzles which eject liquid are open, by relatively moving a wiping member which can wipe off the opening face and the liquid ejecting unit at a first speed in a state in which the opening face, and the wiping member are caused to come into contact with each other;

wiping off the opening face by relatively moving the wiping member and the liquid ejecting unit at a second speed which is lower than the first speed in a state in which the opening face and the wiping member are caused to come into contact with each other; and relatively moving the wiping member and the liquid ejecting unit at a speed which is higher than the first speed in a state in which the opening face and the wiping member are separated from each other.

* * * * *